US006871869B2

(12) United States Patent
Okajima

(10) Patent No.: US 6,871,869 B2
(45) Date of Patent: Mar. 29, 2005

(54) SNOWBOARD BINDING

(75) Inventor: Shinpei Okajima, Izumi (JP)

(73) Assignee: Shimano Inc., Osaka (JP)

( * ) Notice: Subject to any disclaimer, the term of this patent is extended or adjusted under 35 U.S.C. 154(b) by 119 days.

(21) Appl. No.: 10/355,232

(22) Filed: Jan. 31, 2003

(65) Prior Publication Data

US 2004/0150192 A1 Aug. 5, 2004

(51) Int. Cl.[7] ..... A63C 9/00
(52) U.S. Cl. ..... 280/613; 280/617; 280/14.22
(58) Field of Search ..... 280/11.3, 11.31, 280/611, 613, 616, 617, 618, 623, 624, 625, 627, 628, 14.22, 14.24, 11.33

(56) References Cited

U.S. PATENT DOCUMENTS 5,505,477 A * 4/1996 Turner et al. ..... 280/613
5,544,909 A * 8/1996 Laughlin et al. ..... 280/617
5,704,139 A 1/1998 Okajima
5,820,155 A * 10/1998 Brisco ..... 280/607
5,941,553 A * 8/1999 Korman ..... 280/613
6,062,586 A * 5/2000 Korman ..... 280/613
6,099,018 A * 8/2000 Maravetz et al. ..... 280/624
6,145,868 A * 11/2000 Schaller et al. ..... 280/624
6,206,402 B1 3/2001 Tanaka
6,231,066 B1 * 5/2001 Okajima ..... 280/623
6,257,613 B1 * 7/2001 Porte ..... 280/617
6,302,428 B1 10/2001 Jungkind
6,382,641 B2 * 5/2002 Dennis et al. ..... 280/14.22
6,467,795 B1 10/2002 Hirayama et al.
6,616,151 B1 * 9/2003 Golling ..... 280/14.21

* cited by examiner

*Primary Examiner*—Christopher P. Ellis
*Assistant Examiner*—Christopher Bottorff
(74) *Attorney, Agent, or Firm*—Shinjyu Global IP Counselors, LLP

(57) ABSTRACT

A snowboard binding includes a base member, a front binding member, a rear binding member, a front abutment section and a rear abutment section. The front binding member is coupled to the front portion of the base member. The rear binding member is coupled to the rear portion of the base member. The front and rear binding members are arranged and configured to selectively engage a front and rear cleats of a snowboard boot. The front abutment section extends upwardly from the front portion of the base member to laterally support the front binding member. The rear abutment section extends upwardly from the rear portion of the base member to laterally support the rear binding member.

49 Claims, 30 Drawing Sheets

SNOWBOARD BINDING

BACKGROUND OF THE INVENTION

1. Field of the Invention

This invention generally relates to a snowboard binding. More specifically, the present invention relates to a snowboard binding in which a snowboard boot is easily and securely attached thereto.

2. Background Information

In recent years, snowboarding has become a very popular winter sport. In fact, snowboarding was an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt, thus causing the snowboard to turn in the direction of the lean. Similarly, leaning forward causes the board to tilt in a corresponding manner and thus causes the snowboard to turn in that direction.

Generally, the sport of snowboarding may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots or adaptations of such boots are typically worn and fitted into so-called soft bindings.

In either case, it is important that the boots worn by the rider have sufficient rigidity to transfer such leaning motion to the snowboard. Additionally, it is important that the binding mechanisms securely couple the boots to the snowboard so the rider is able to accurately control the snowboard at all times. In recent years, snowboard binding systems have been designed, with improved performance. However, these typical snowboard binding systems can be difficult and/or expensive to manufacture and/or assemble. Moreover, these typical snowboard binding systems can be cumbersome and/or difficult to engage and/or disengage for the rider. Furthermore, these typical snowboard binding systems can be uncomfortable for the rider.

In view of the above, there exists a need for a snowboard binding which overcomes the above mentioned problems in the prior art. This invention addresses this need in the prior art as well as other needs, which will become apparent to those skilled in the art from this disclosure.

SUMMARY OF THE INVENTION

One object of the present invention is to provide a snowboard binding that provides lateral stability between the snowboard binding and the snowboard boat.

Another object of the present invention is to provide a snowboard binding that is relatively simple and inexpensive to manufacture and/or assemble.

Another object of the present invention is to provide a snowboard binding that is relatively easy to engage and/or disengage for the rider.

Yet another object of the present invention is to provide a snowboard binding that comfortable yet secure for the rider.

The foregoing objects can basically be attained by providing a snowboard binding that comprises a base member, a front binding member, a rear binding member, a front abutment section and a rear abutment section. The base member includes a front portion, a rear portion, a central portion arranged between the front and rear portions and a longitudinal axis extending between the front and rear portions. The central portion has a central attachment area configured to be fixedly coupled to a snowboard. The front binding member is coupled to the base member at the front portion of the base member. The front binding member is arranged and configured to selectively engage a front cleat of a snowboard boot. The rear binding member is coupled to the base member at the rear portion of the base member. The rear binding member is arranged and configured to selectively engage a rear cleat of the snowboard boot. The front abutment section extends upwardly from the front portion of the base member. The front abutment section laterally supports the front binding member. The rear abutment section extends upwardly from the rear portion of the base member, the rear abutment section laterally supporting the rear binding member.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

Figure 1:
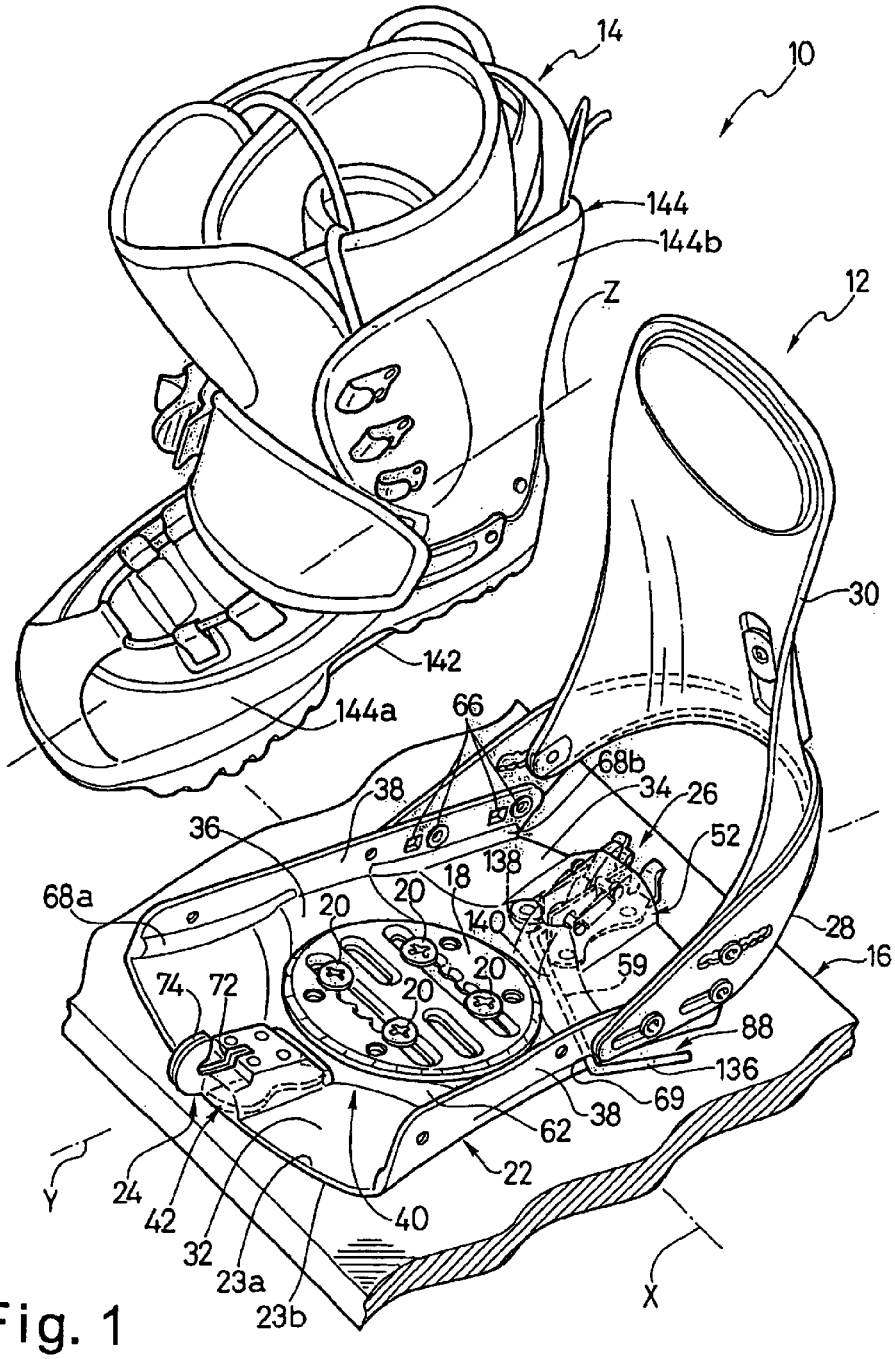
FIG. 1 is a partial, exploded perspective view of a portion of a snowboard with a snowboard binding coupled thereto and a snowboard boot about to be coupled to the snowboard binding in accordance with one in embodiment of the present invention.
Figure 2:
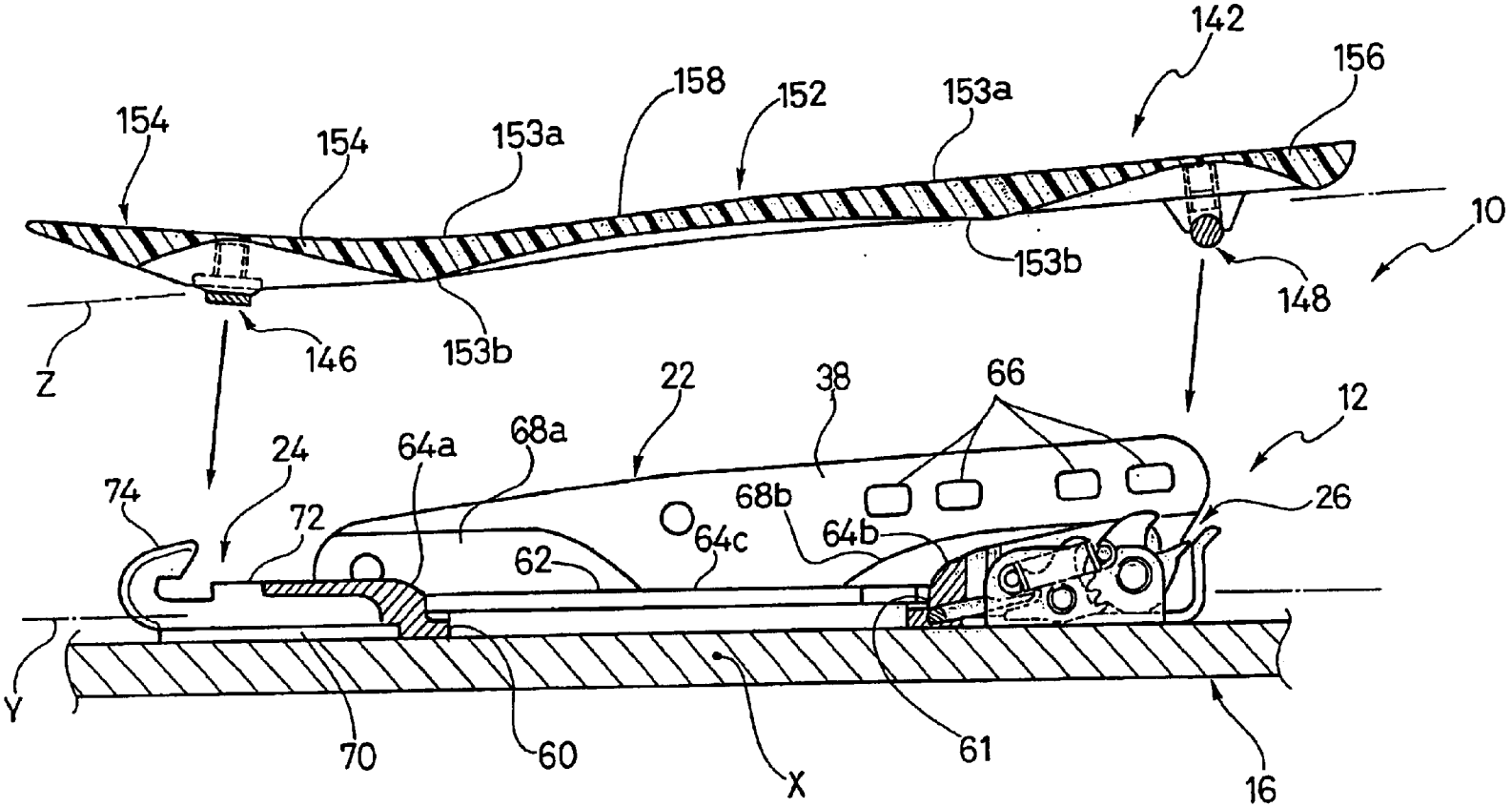
FIG. 2 is a longitudinal cross-sectional view of the mid sole portion of the snowboard boot and the snowboard binding illustrated in FIG. 1.
Figure 3:
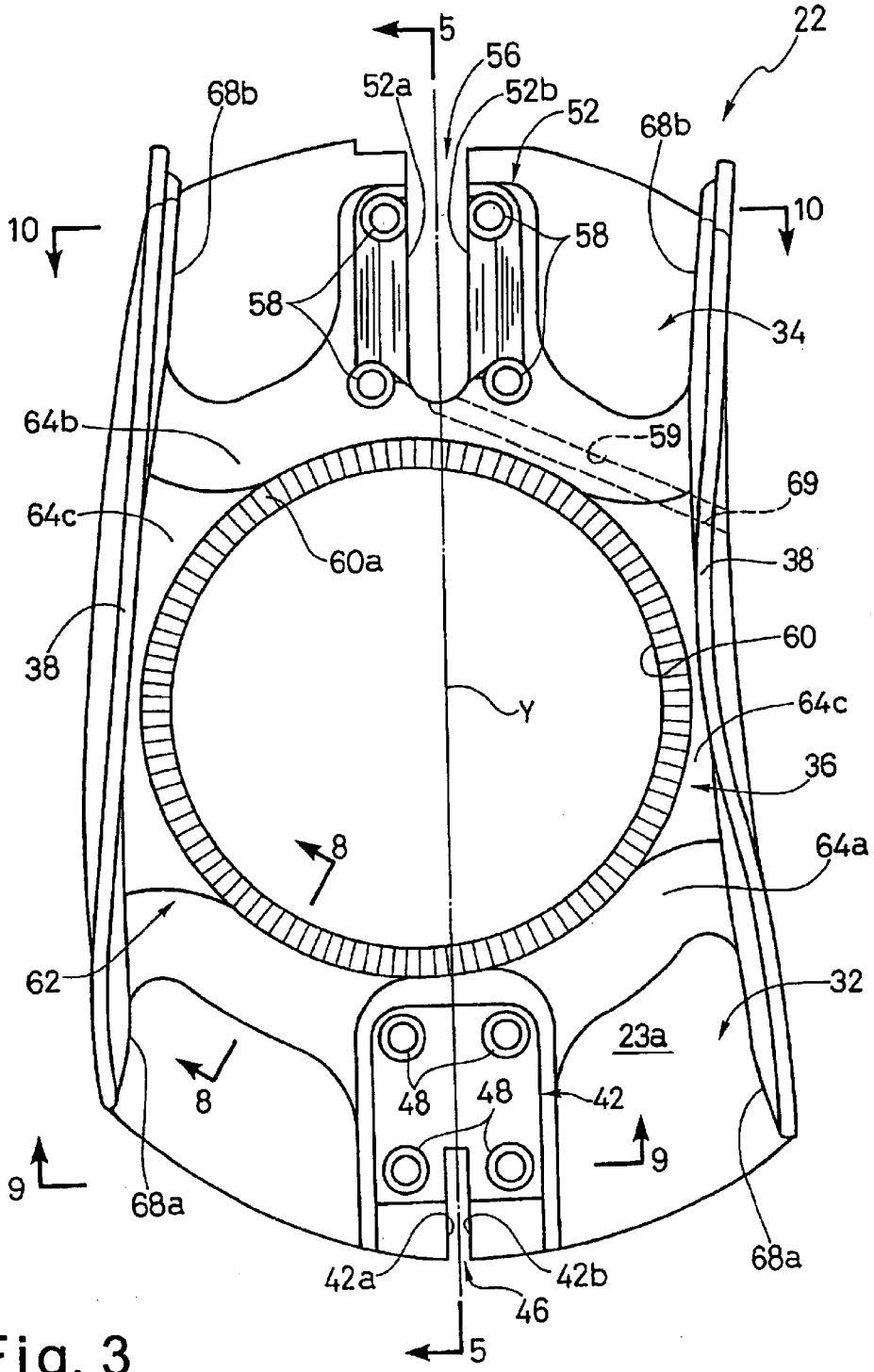
FIG. 3 is a top plan view of the base member for the snowboard binding illustrated in FIGS. 1 and 2 in accordance with the present invention.
Figure 9:
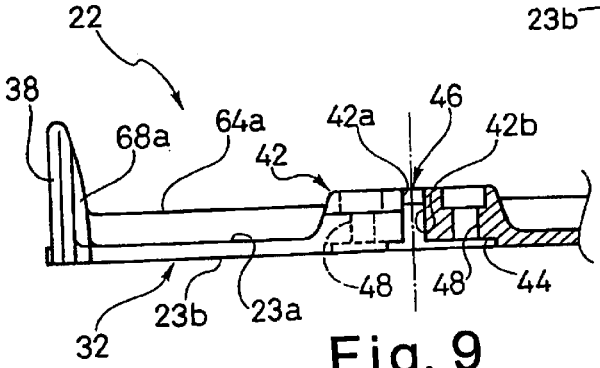
Figure 10:
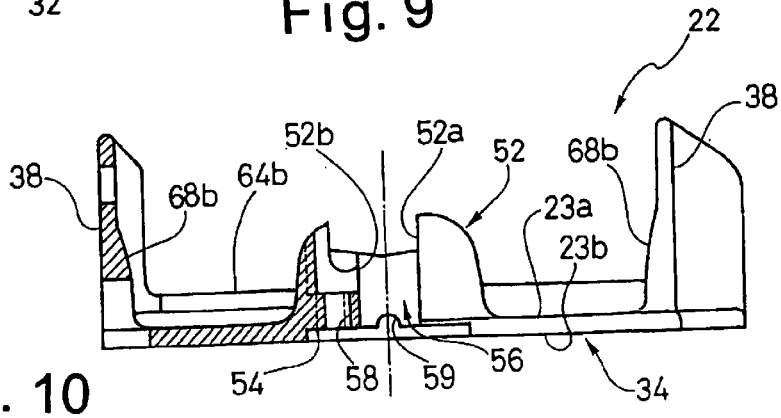
Figure 11:
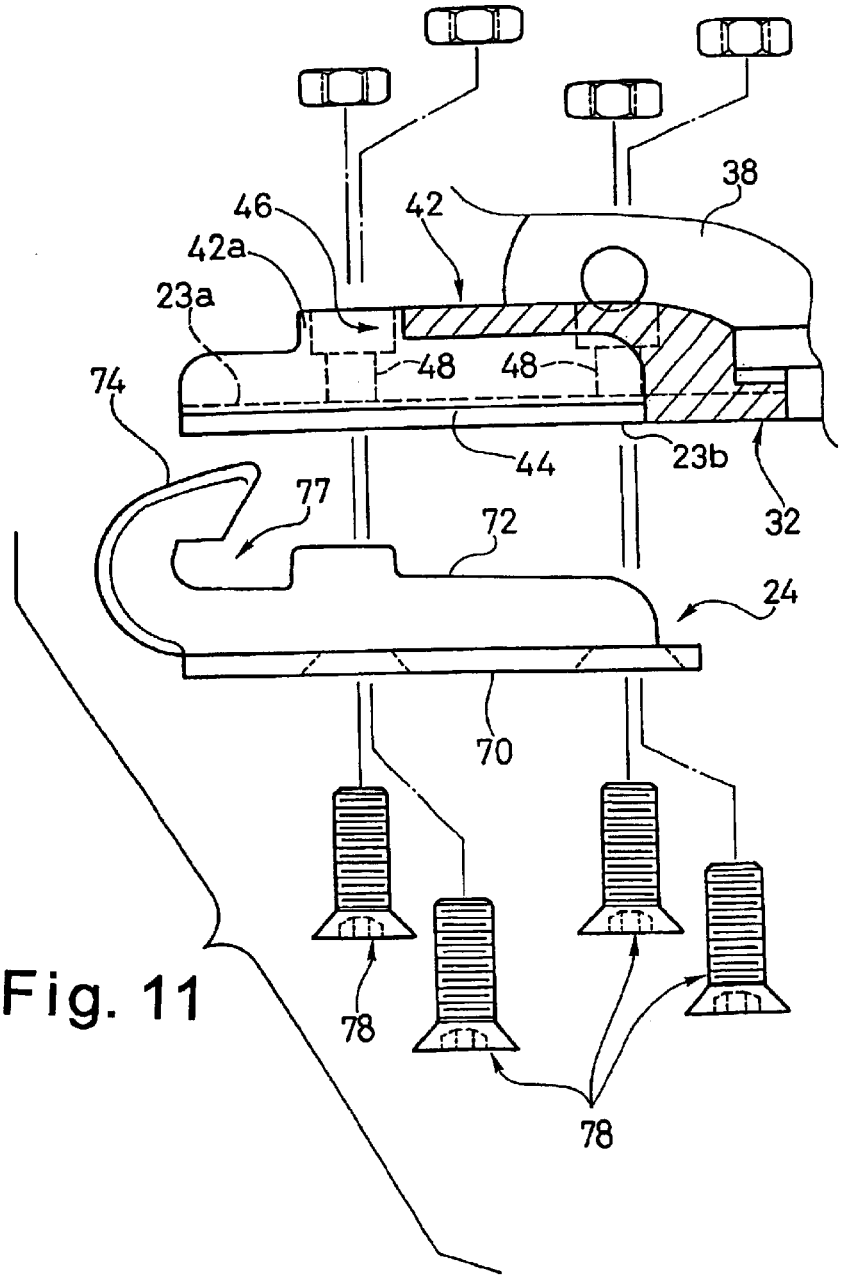
Figure 12:
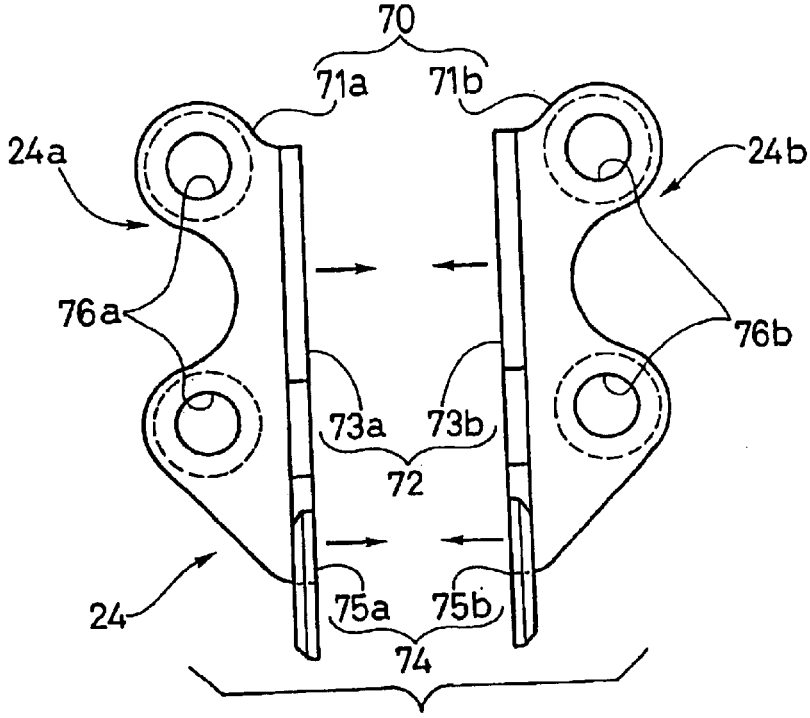
Figure 13:
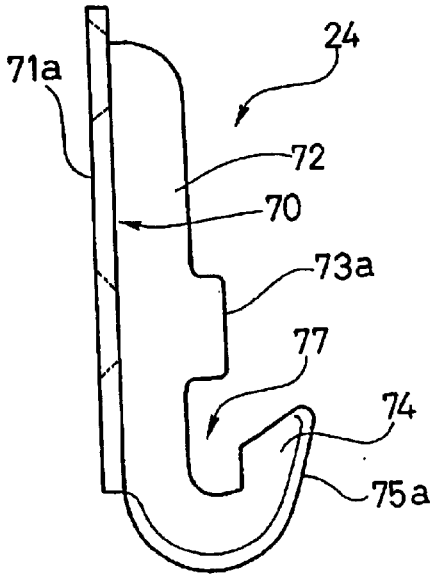
Figure 14:
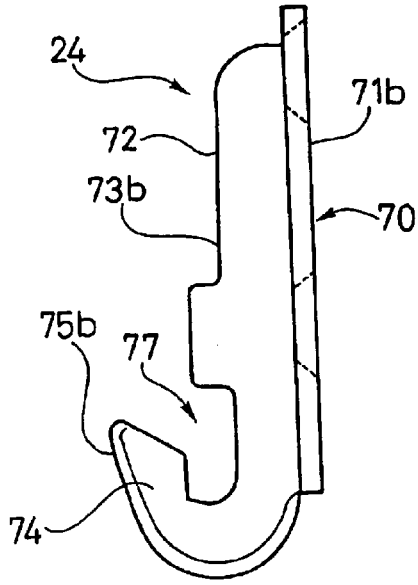
Figure 15:
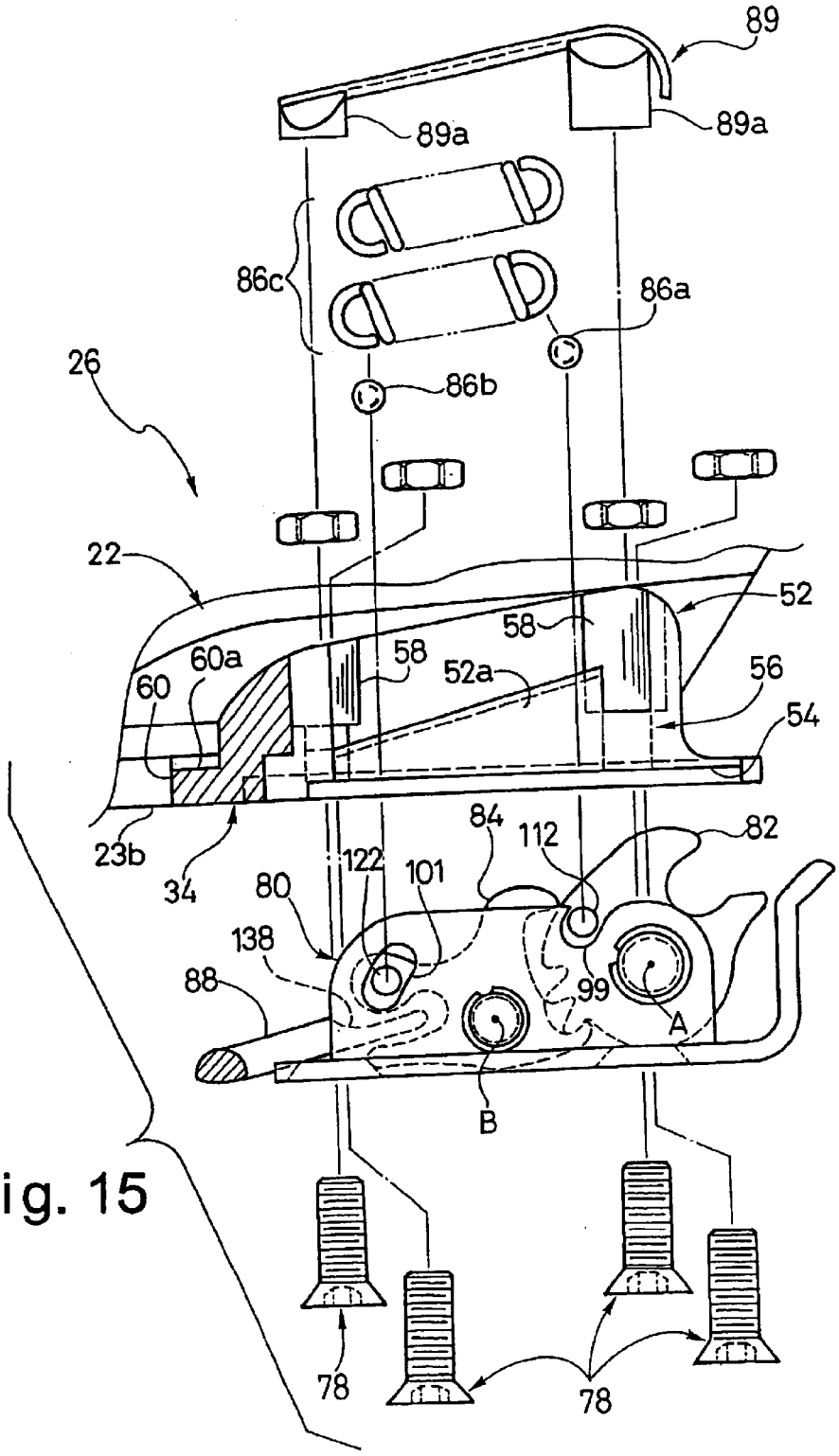
Figure 16:
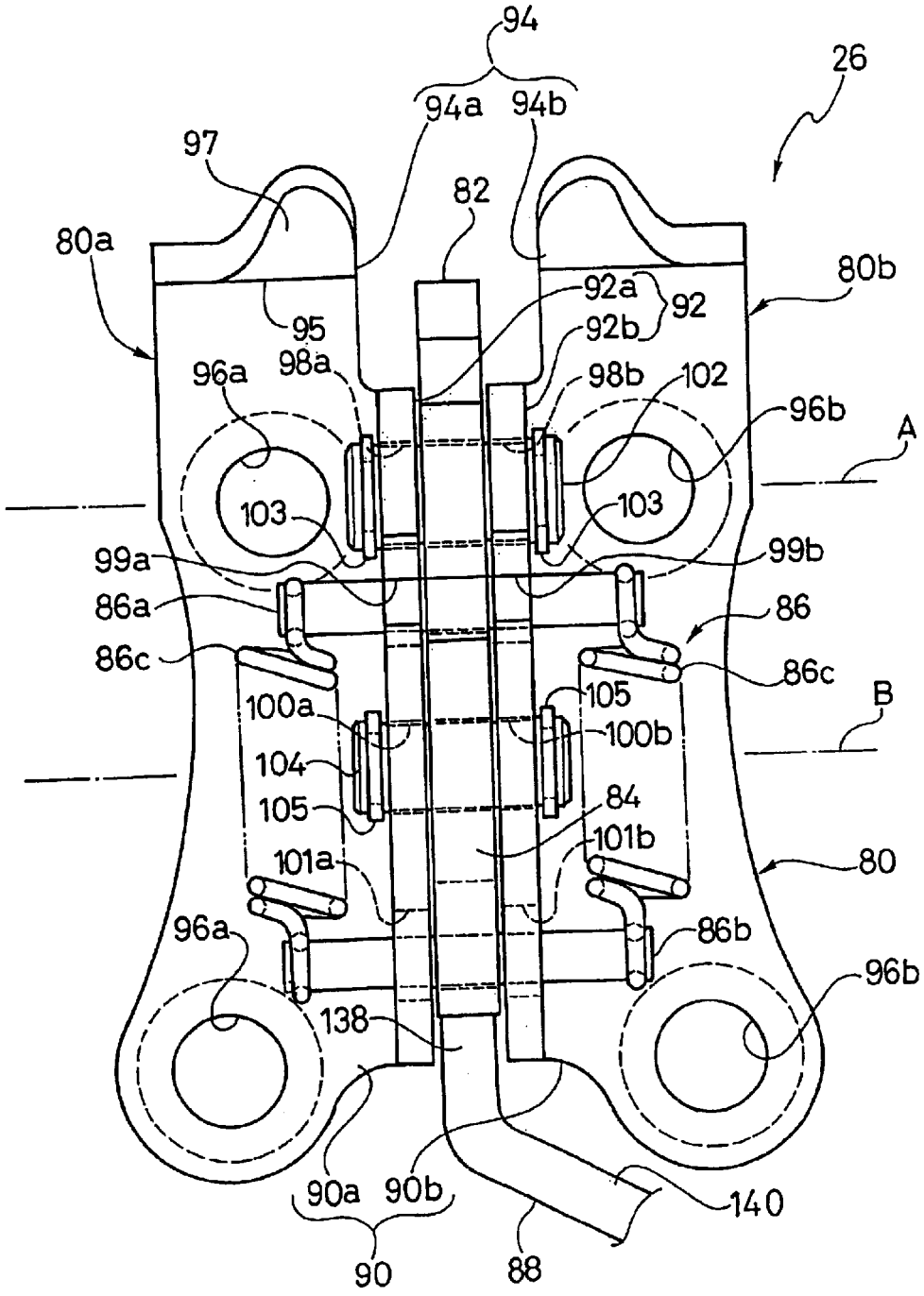
Figure 17:
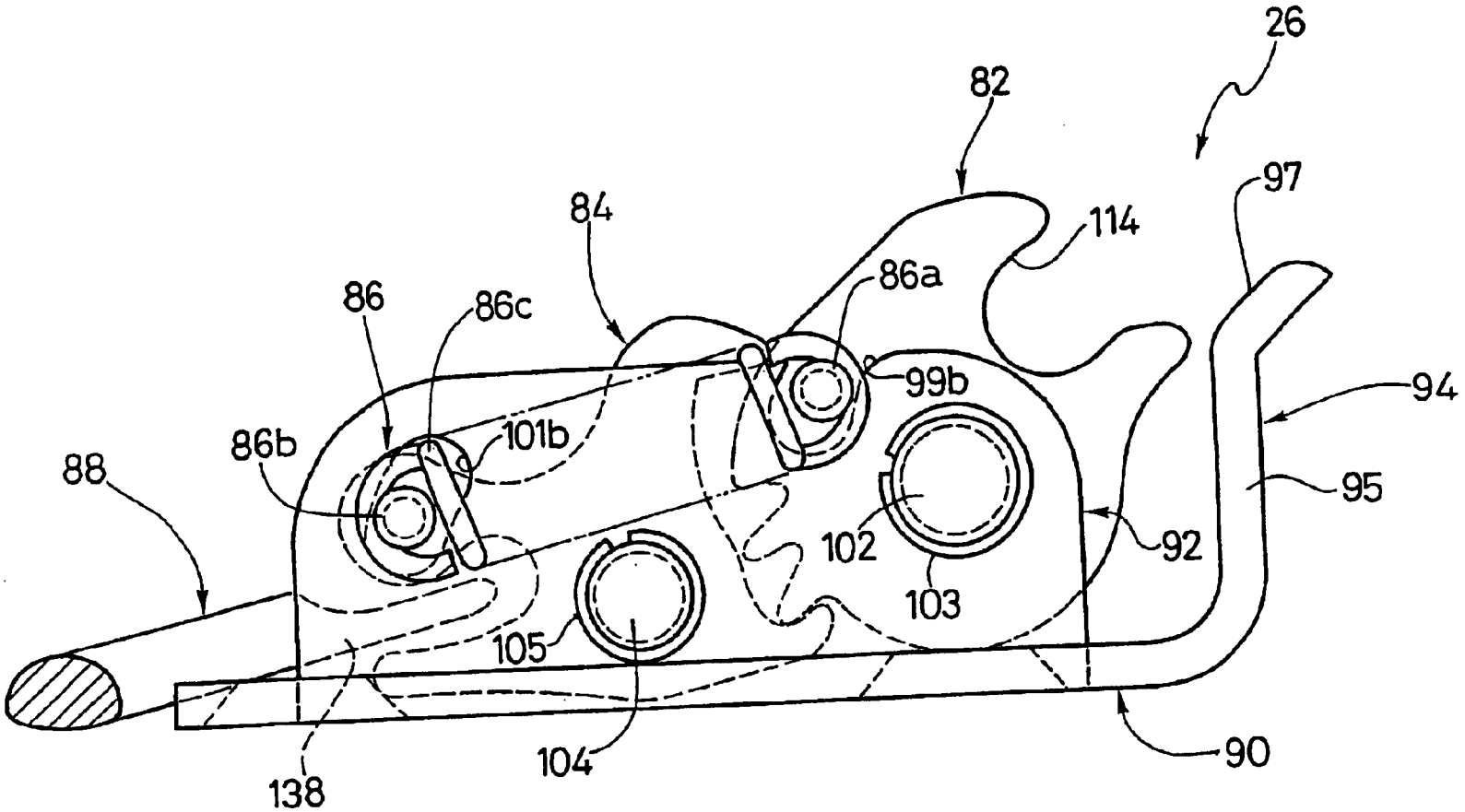
Figure 18:
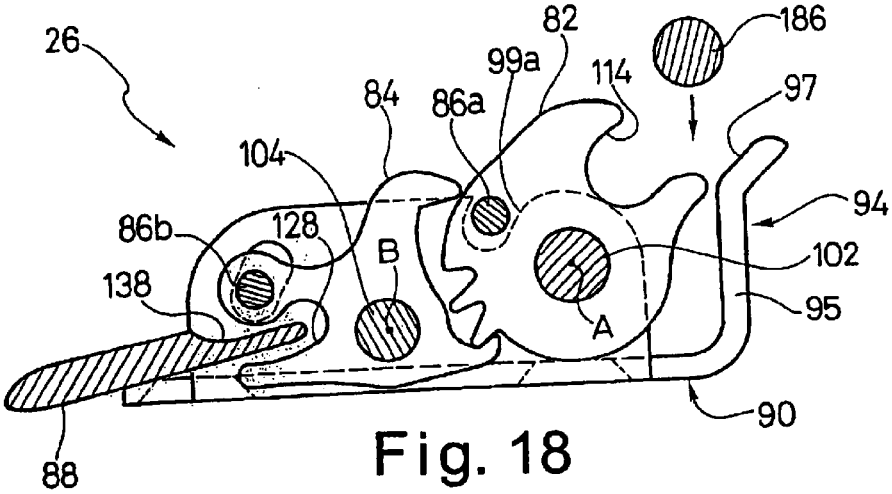
Figure 19:
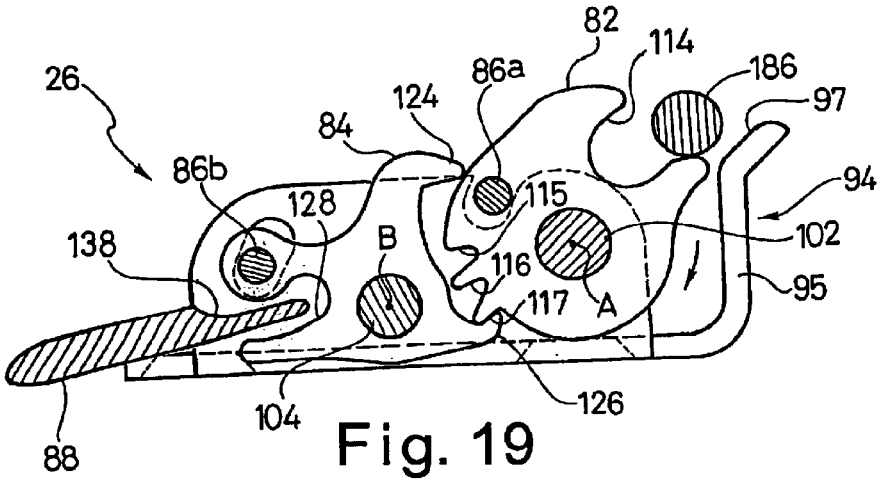
Figure 20:
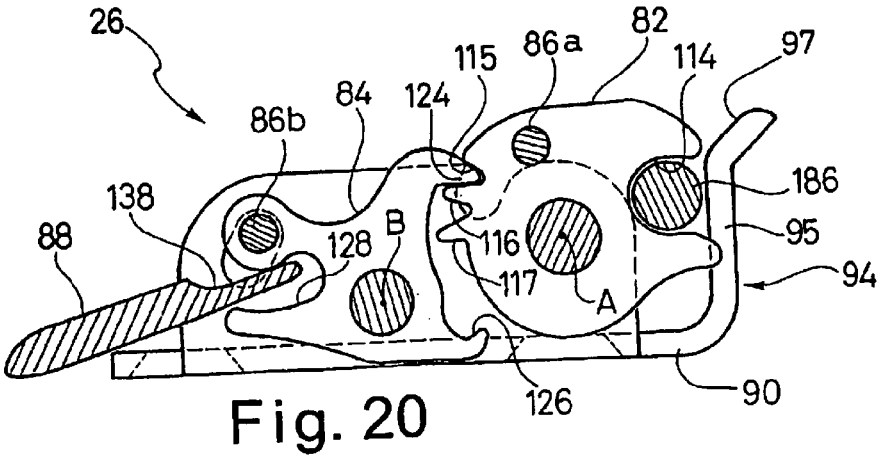
Figure 21:
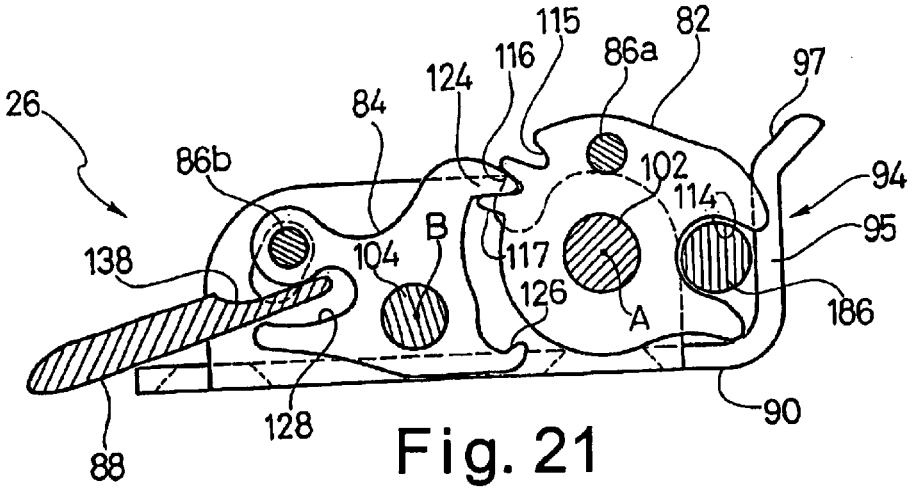
Figure 22:
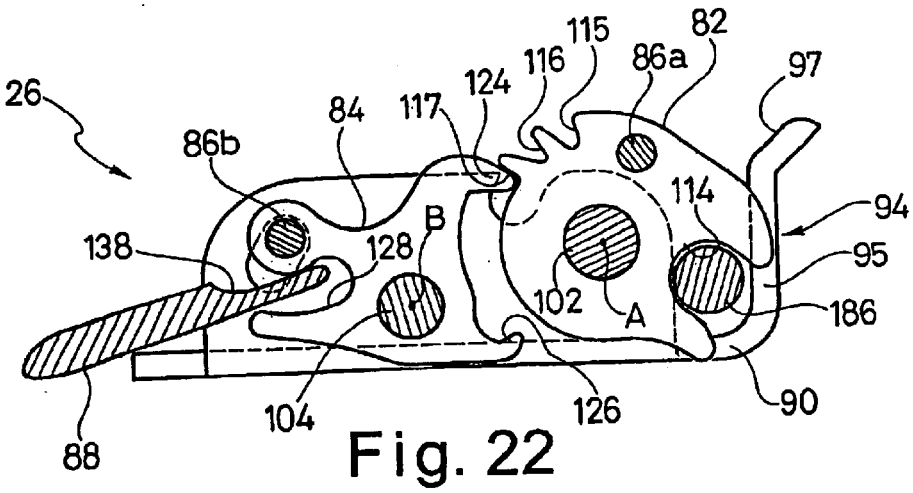
Figure 23:
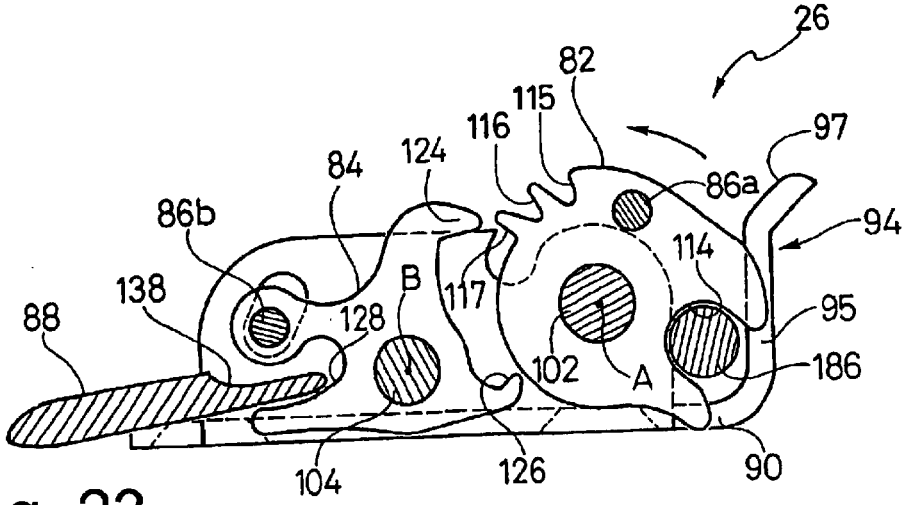
Figure 24:
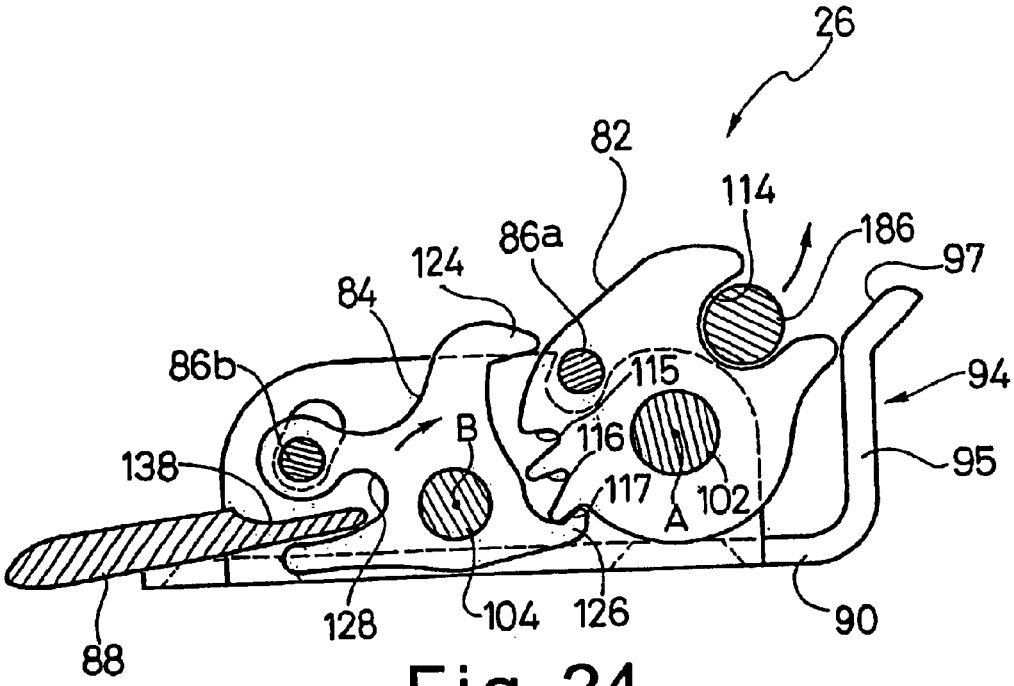
Figure 25:
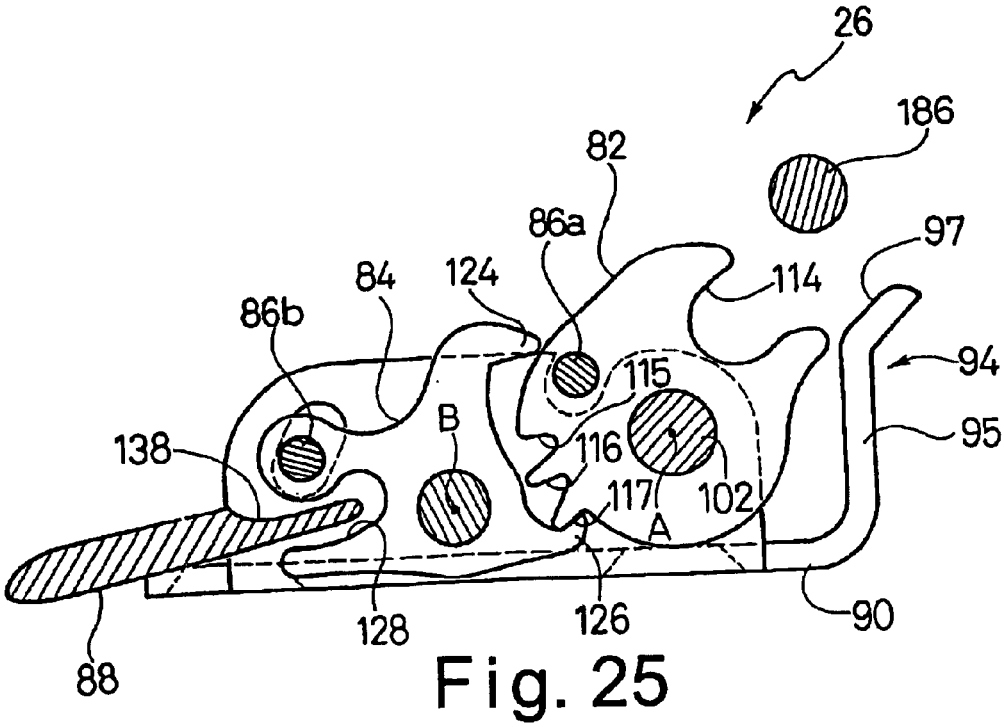
Figure 26:
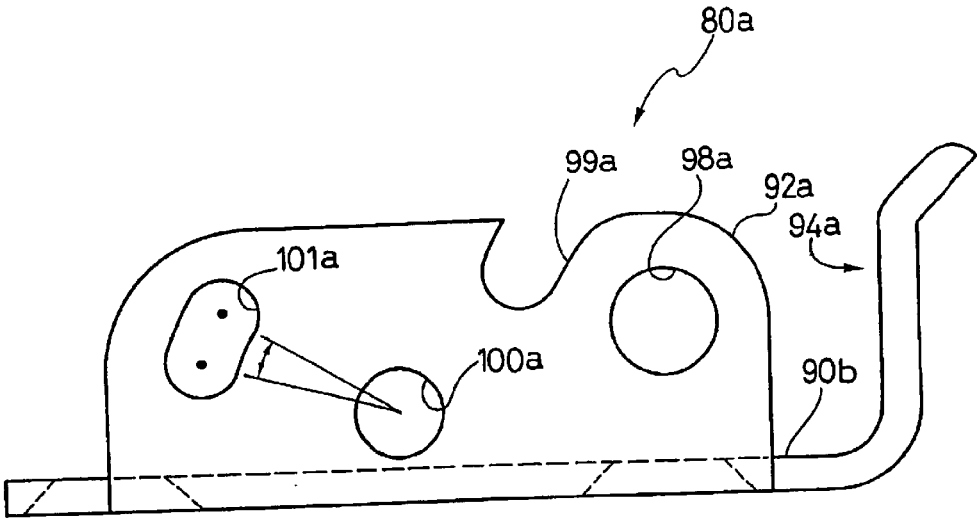
Figure 27:
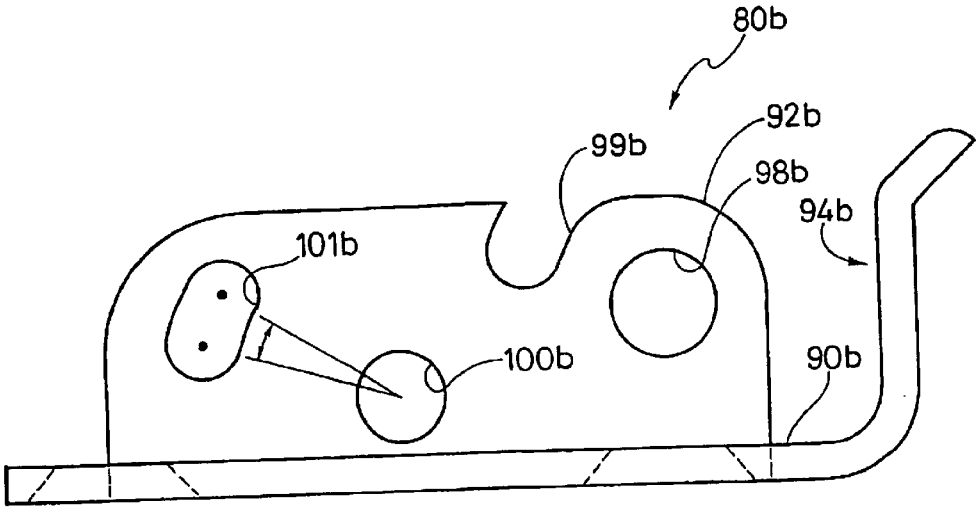
Figure 28:
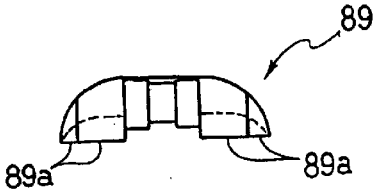
Figure 31:
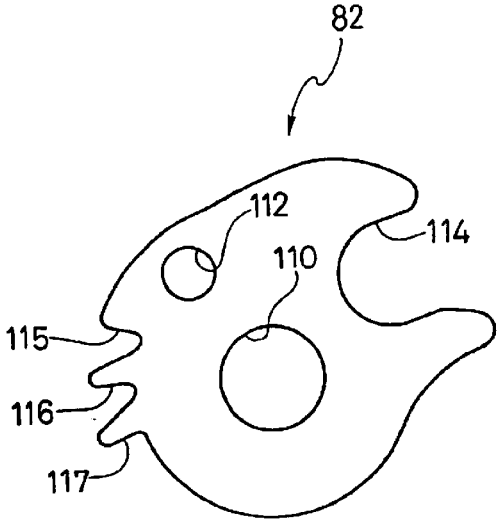
Figure 29:
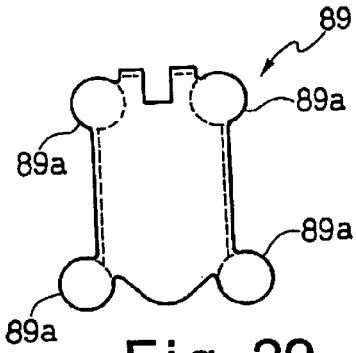
Figure 32:
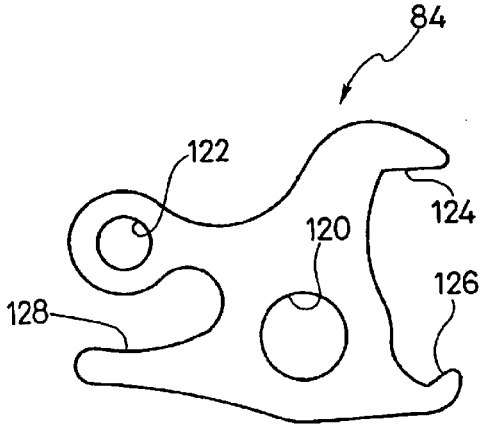
Figure 30:
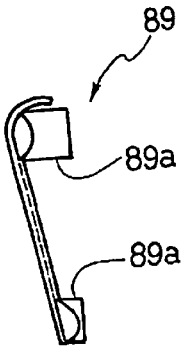
Figure 33:
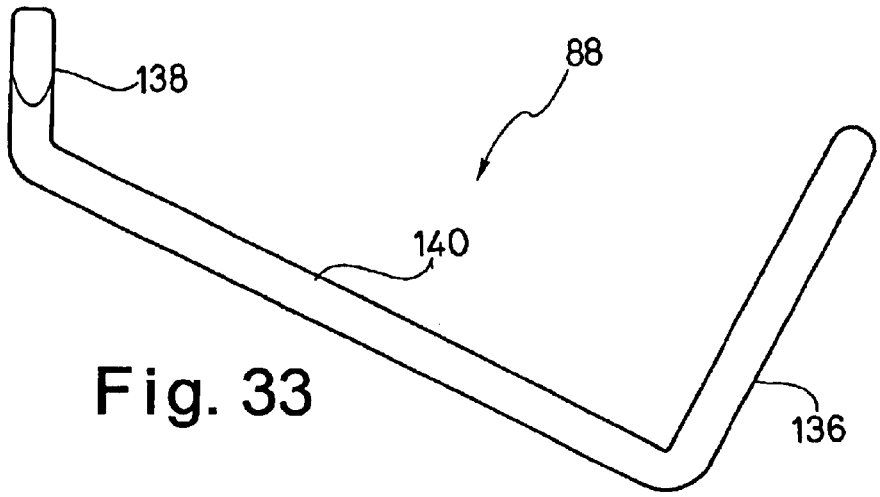
Figure 34:
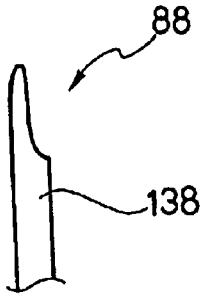
Figure 35:
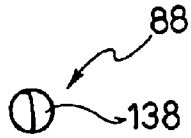
Figure 36:
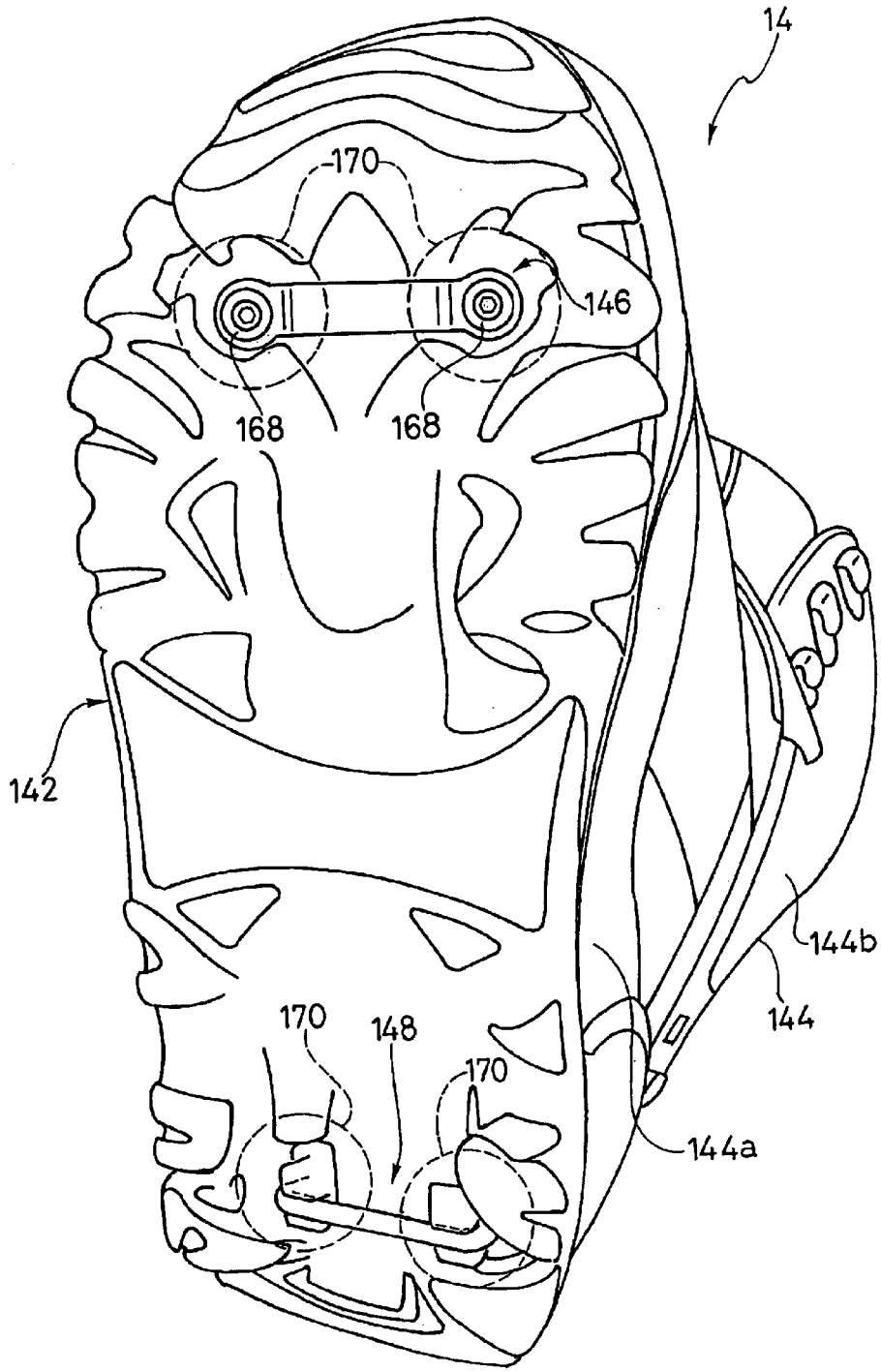
Figure 37:
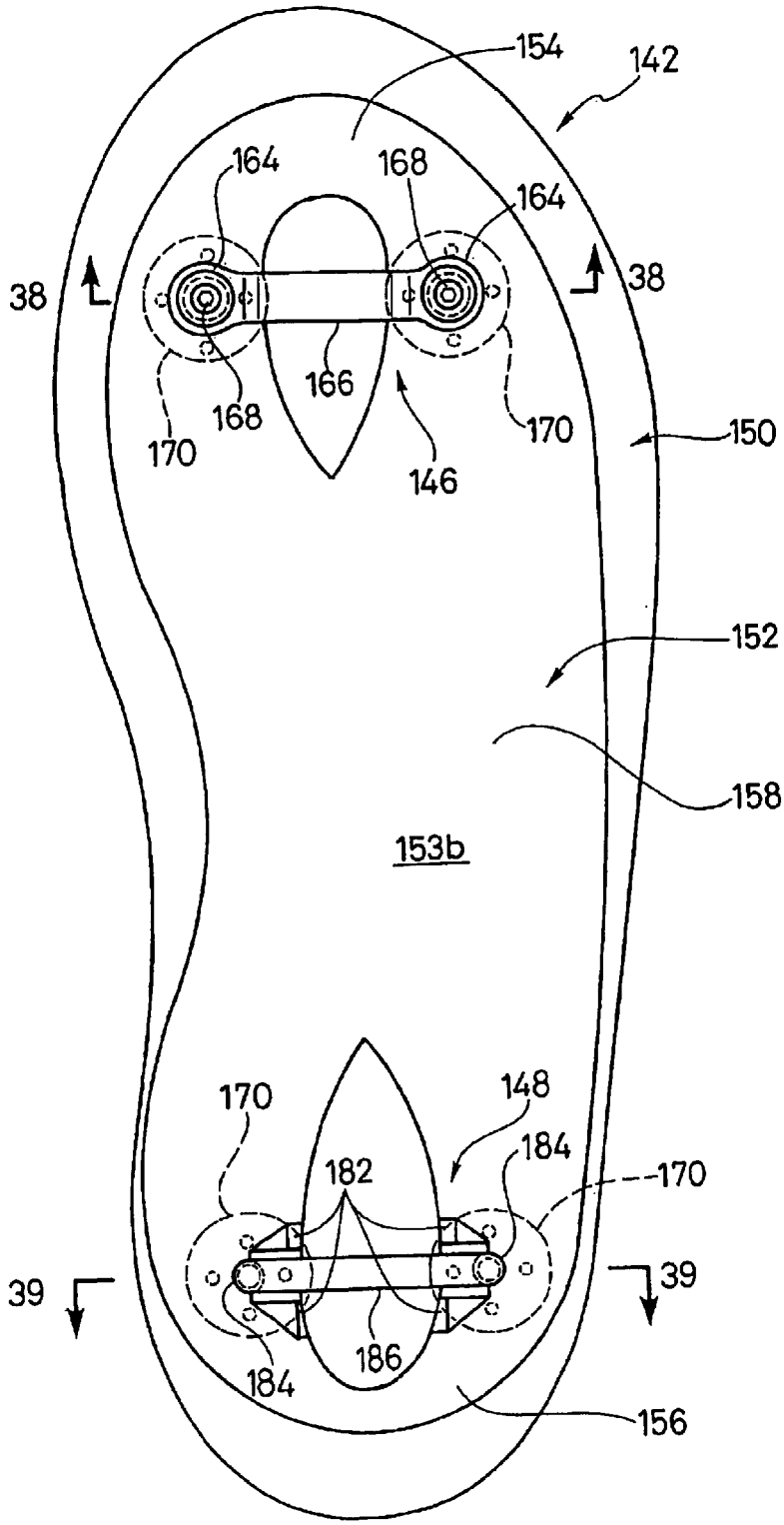
Figure 38:
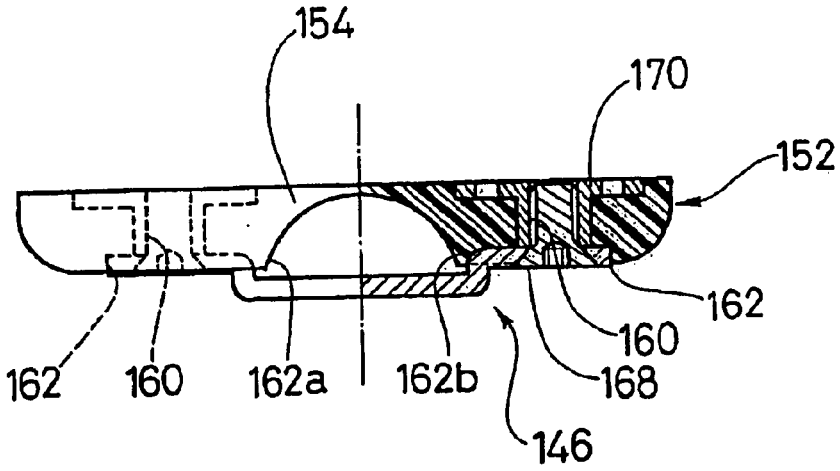
Figure 39:
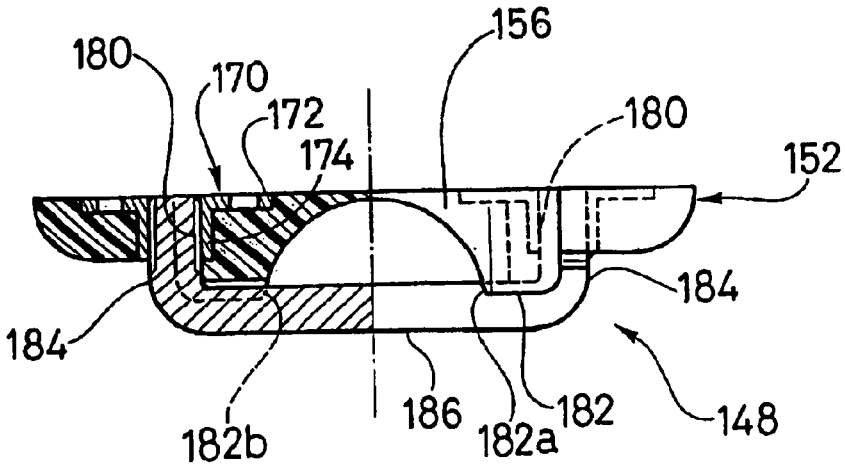
Figure 40:
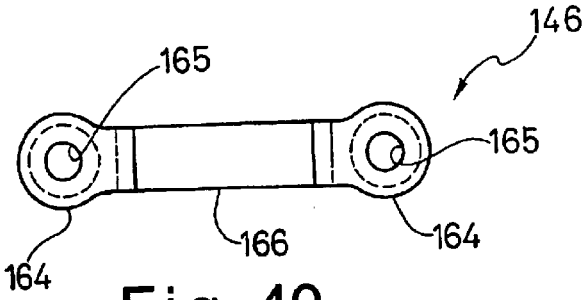
Figure 44:
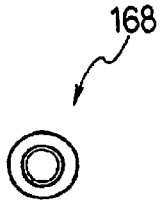
Figure 41:
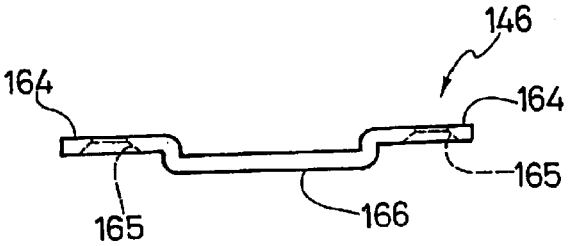
Figure 45:
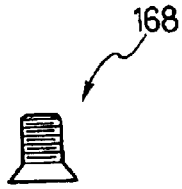
Figure 42:
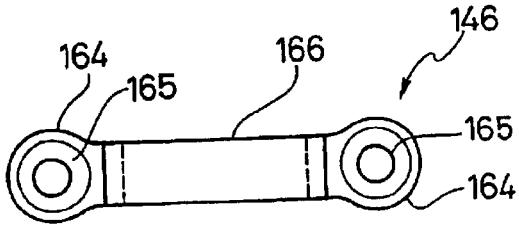
Figure 46:
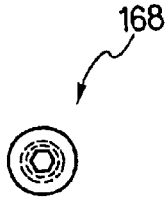
Figure 43:
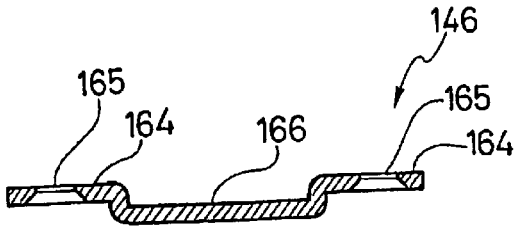
Figure 51:
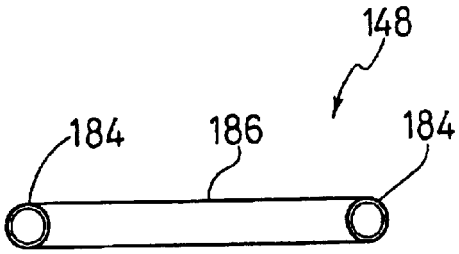
Figure 47:
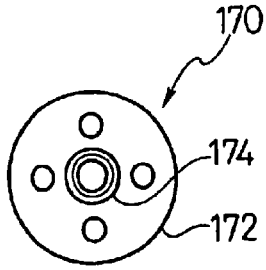
Figure 48:
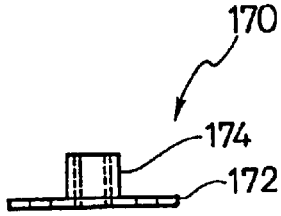
Figure 52:
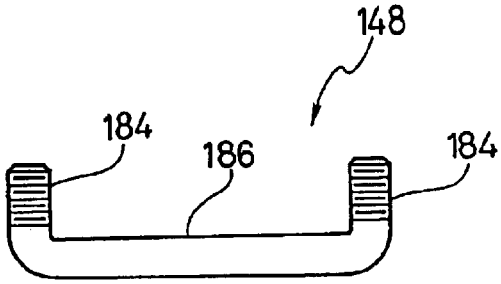
Figure 49:
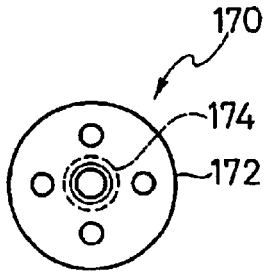
Figure 53:
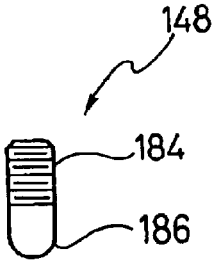
Figure 50:
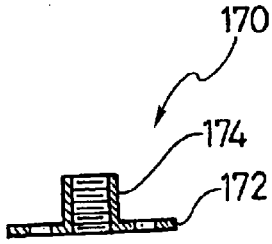
Figure 54:
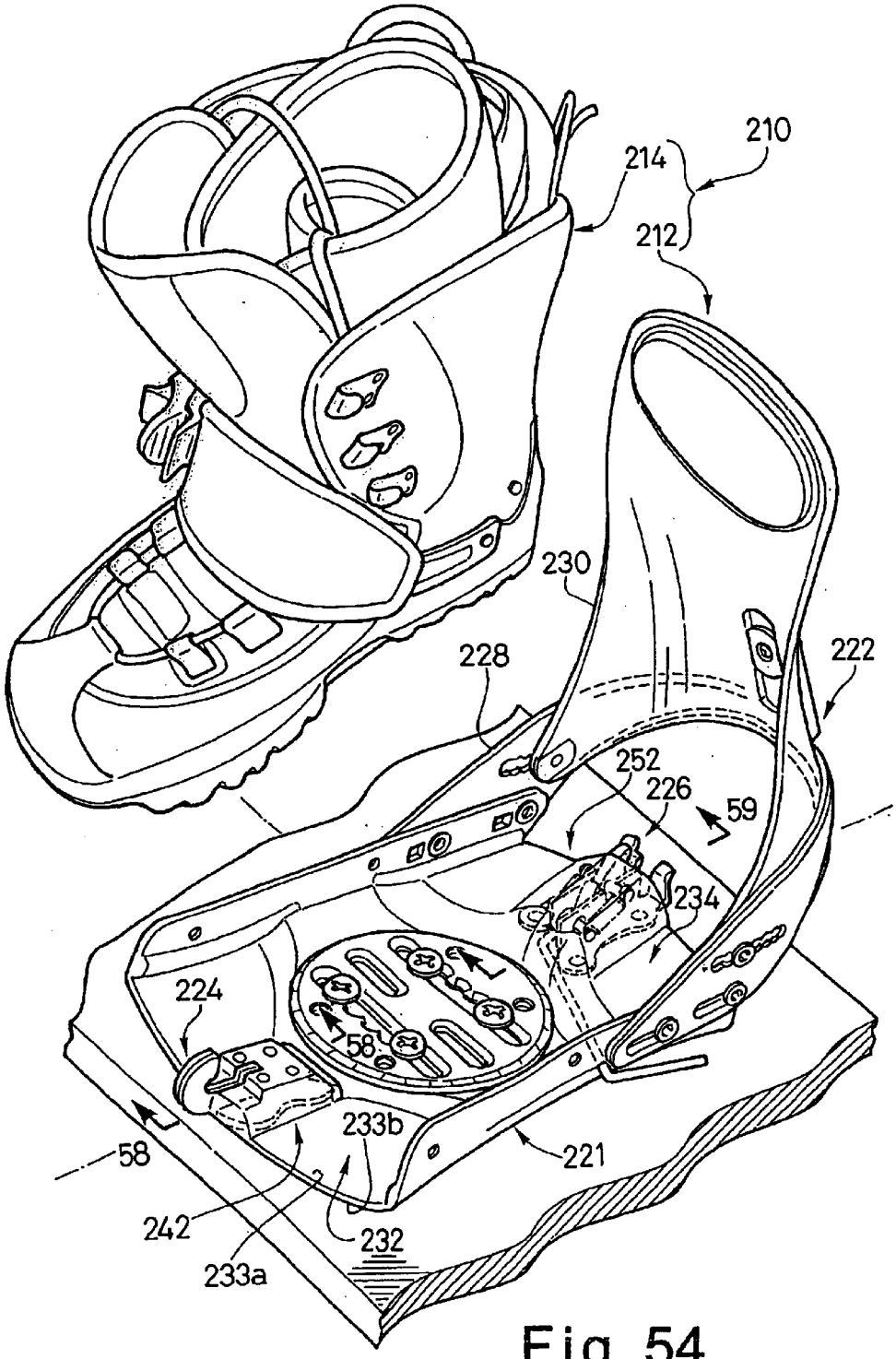
Figure 55:
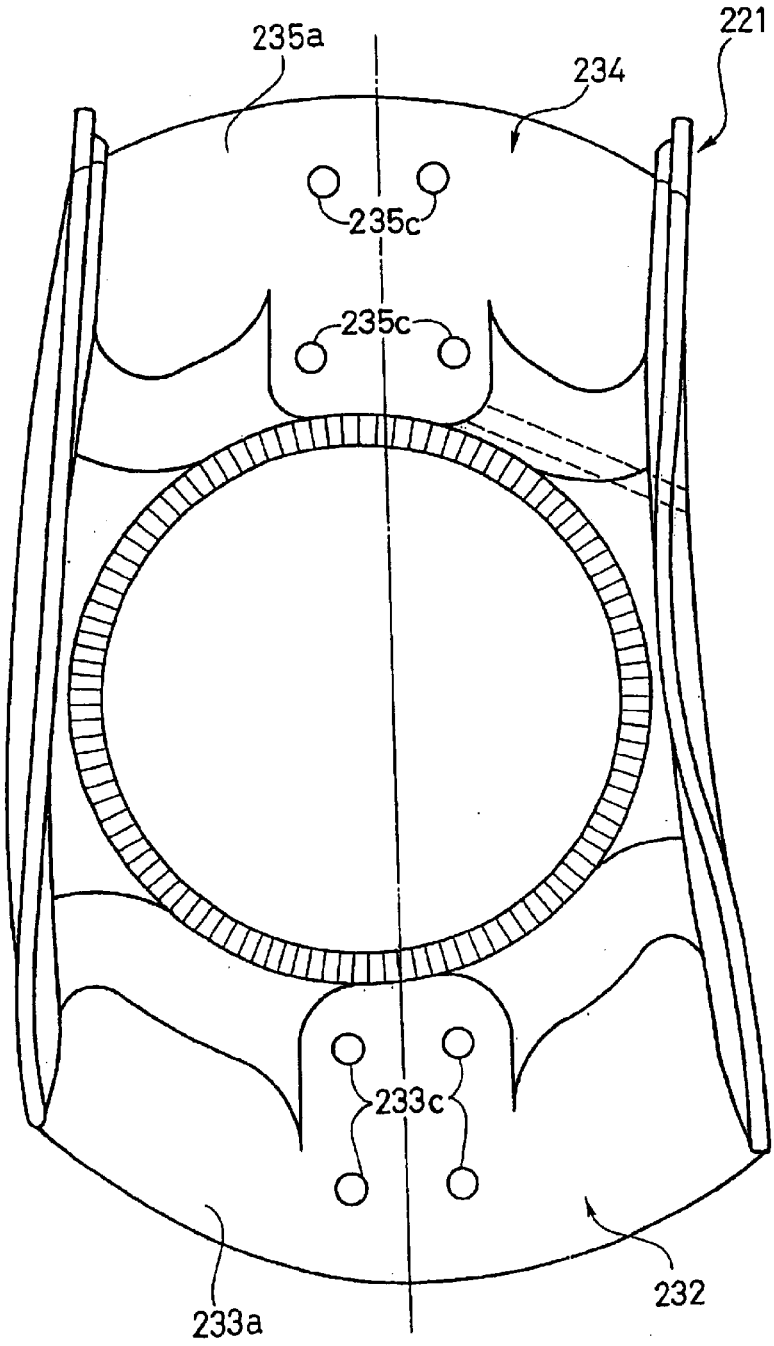
Figure 56:
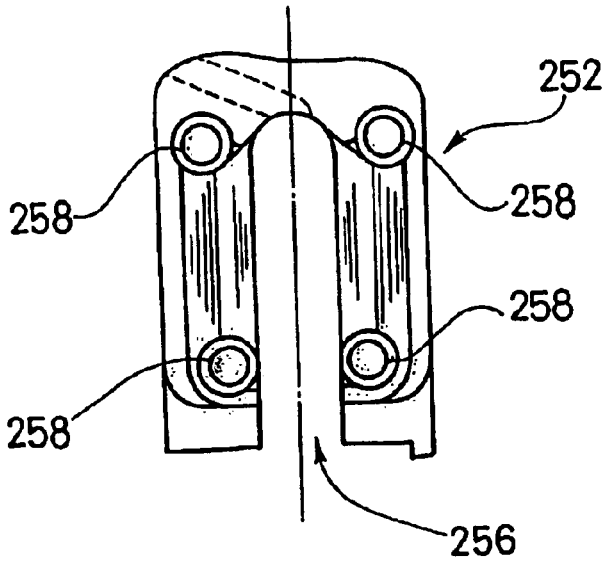
Figure 57:
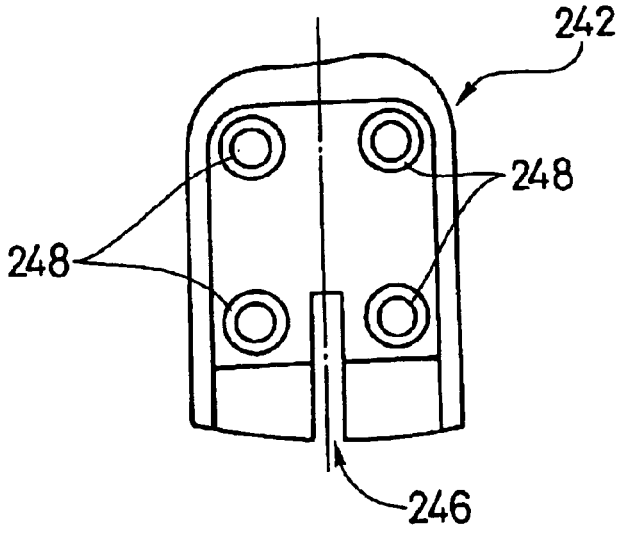
Figure 58:
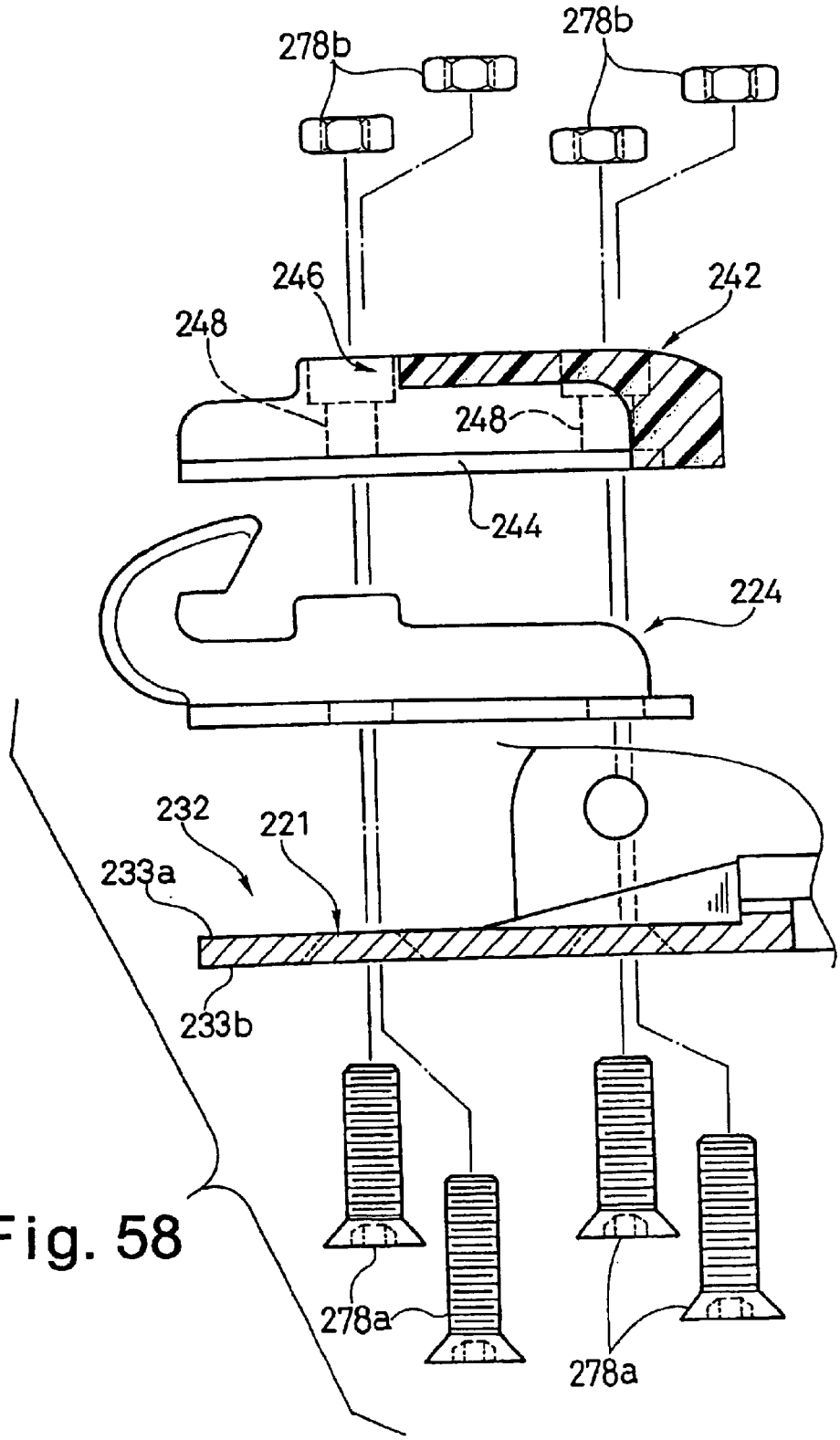
Figure 59:
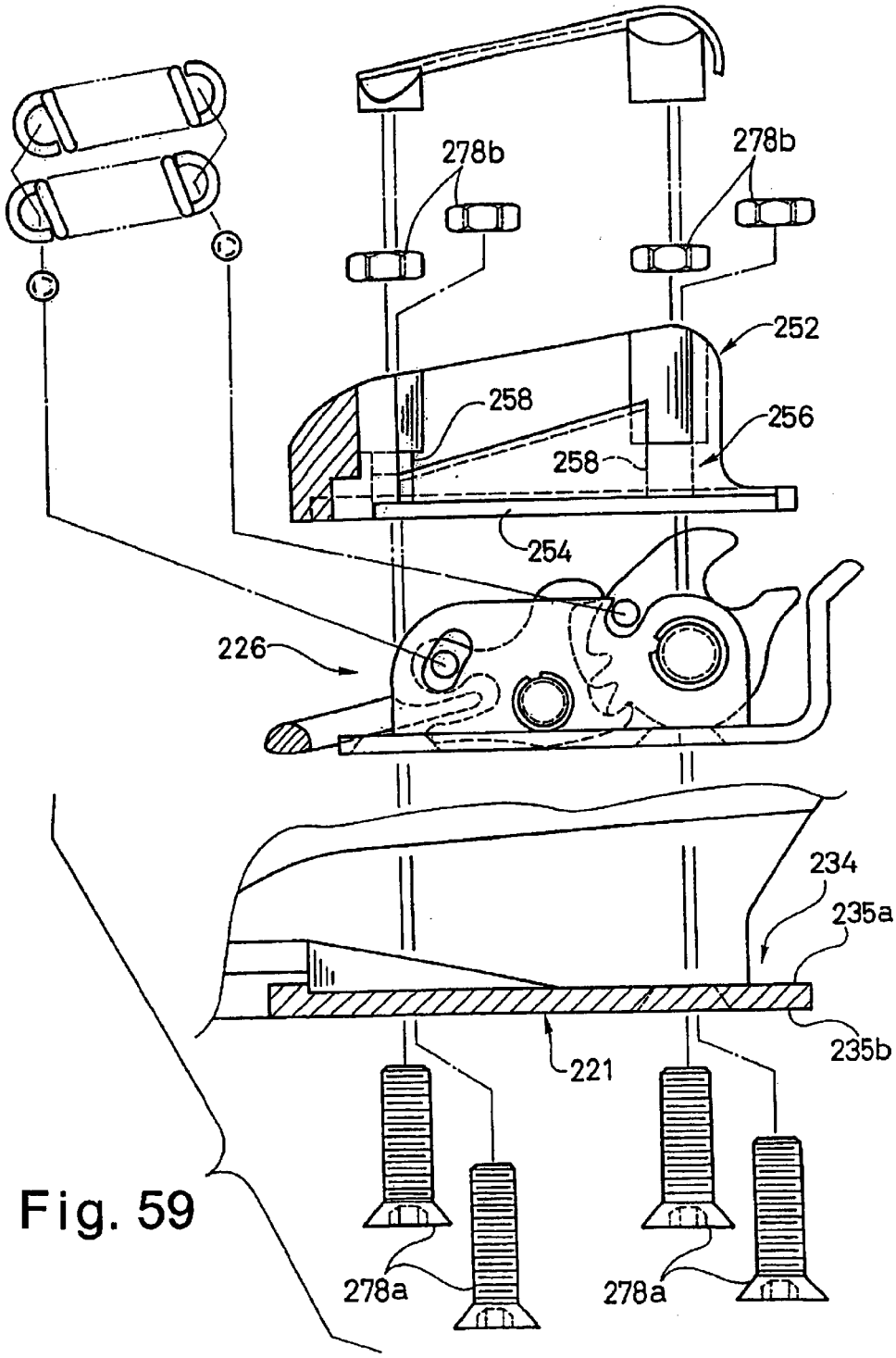
Figure 60:
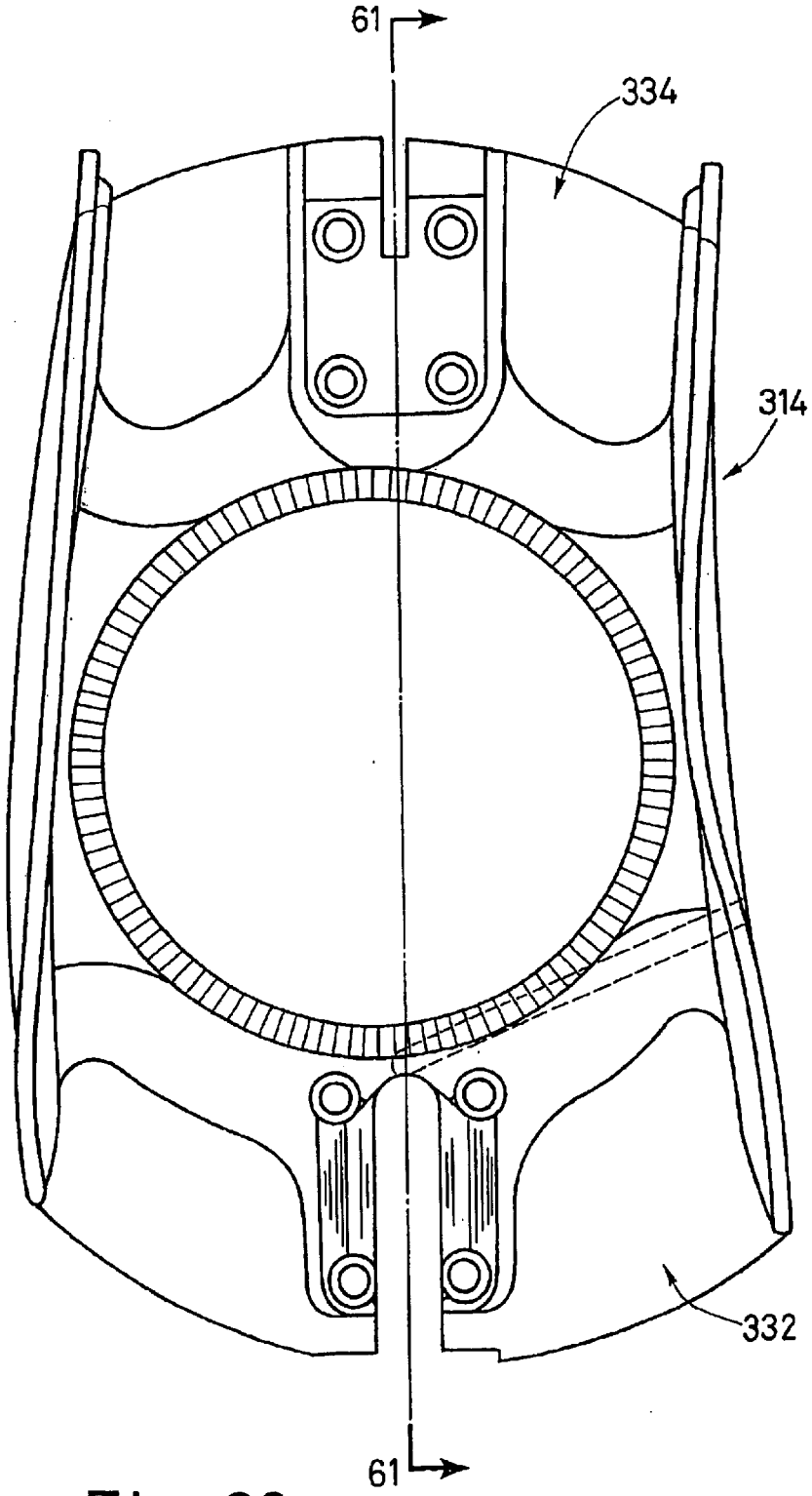
Figure 61:
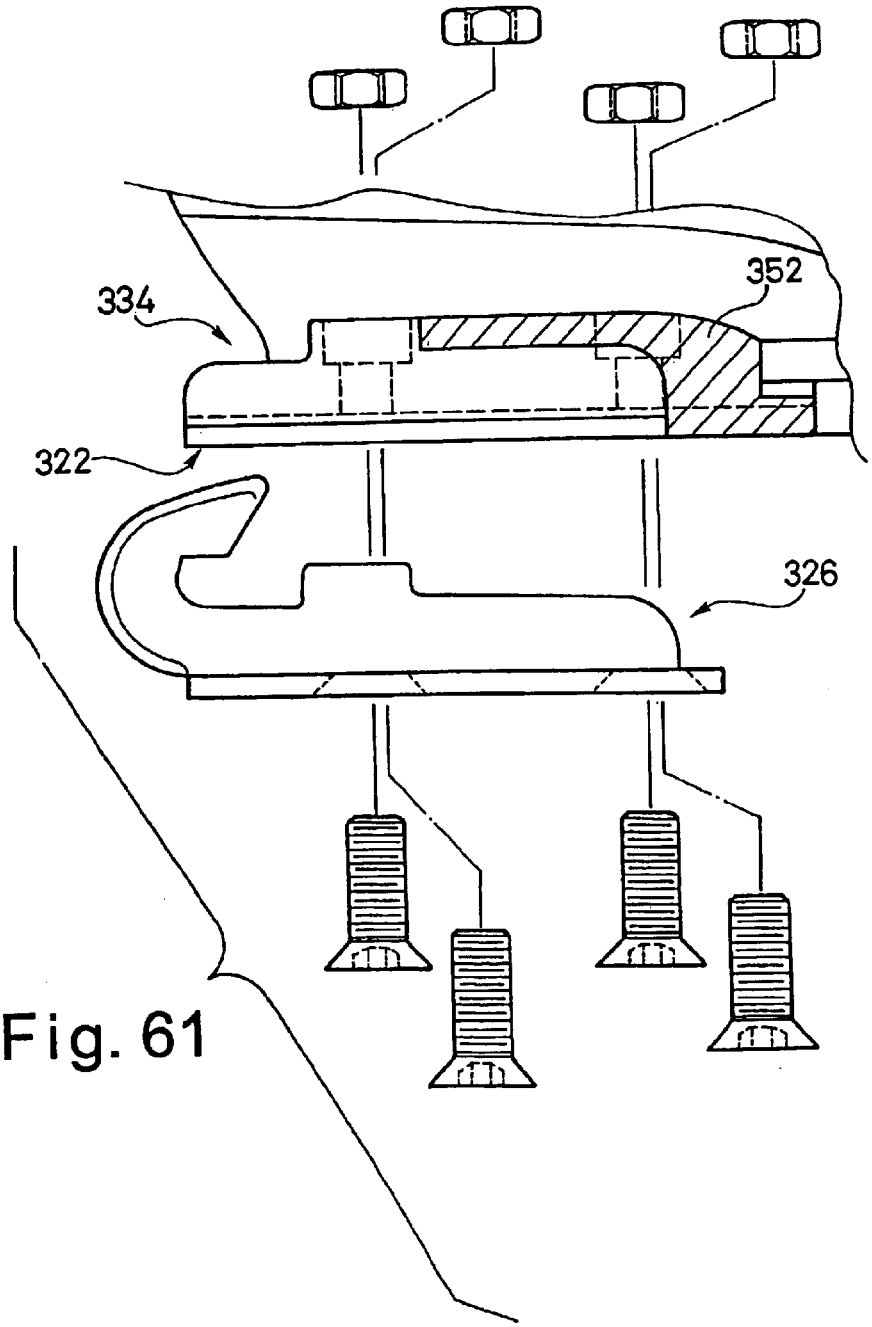
Figure 62:
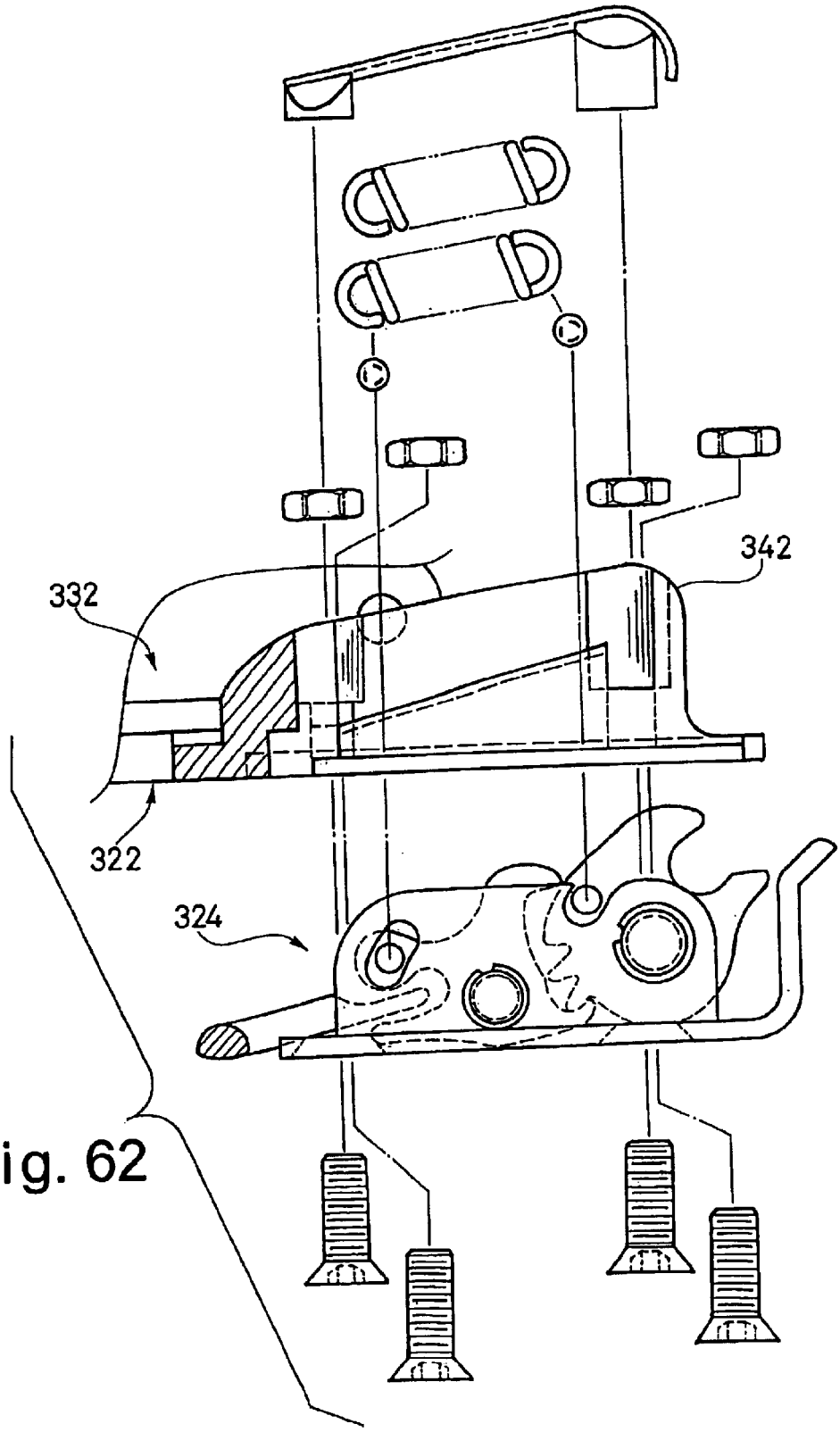
Figure 63:
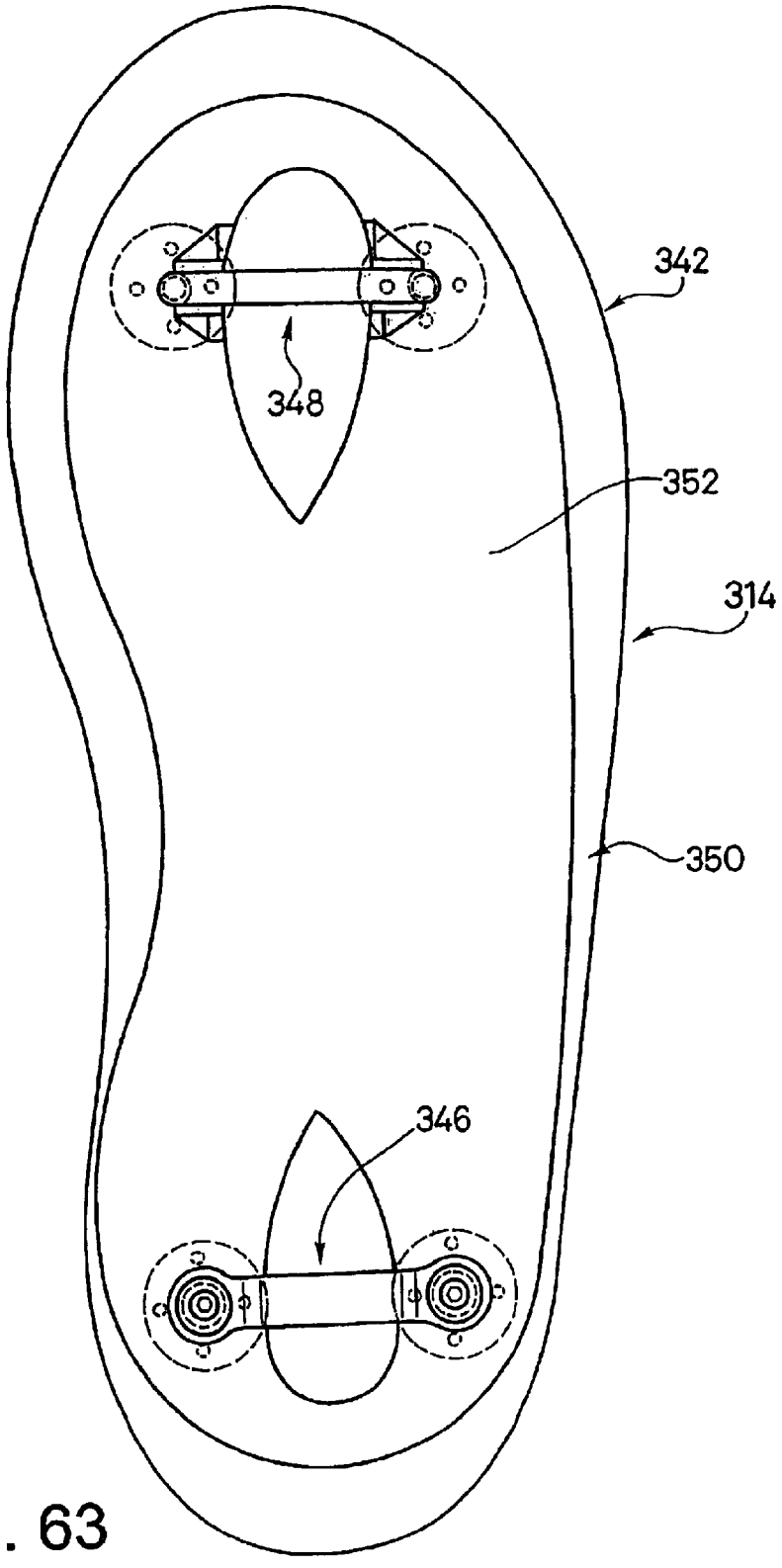

3–7 for the snowboard binding illustrated in FIGS. 1 and 2 as seen along section line 8—8 of FIG. 3;

FIG. 9 is a partial transverse cross-sectional view of the front portion of the base member illustrated in FIGS. 3–8 for the snowboard binding illustrated in FIGS. 1 and 2 as seen along section line 9—9 of FIG. 3;

FIG. 10 is a partial transverse cross-sectional view of the rear portion of the base plate illustrated in FIGS. 3–9 for the snowboard binding illustrated in FIGS. 1 and 2 as seen along section line 10—10 of FIG. 3;

FIG. 11 is a partial, exploded side elevational view of the front binding member the front portion of the base member shown in cross-section for the purpose of illustration;

FIG. 12 is an exploded top plan view of the front binding member illustrated in FIG. 11 for the snowboard binding illustrated in FIGS. 1 and 2;

FIG. 13 is a first side elevational view of the front binding member illustrated in FIGS. 11 and 12;

FIG. 14 is a second side elevational view of the front binding member illustrated in FIGS. 11–13;

FIG. 15 is a partial, exploded elevational view of the rear binding member or mechanism with the rear portion of the base member shown in cross-section for the purpose of illustration;

FIG. 16 is a top plan view of the rear binding mechanism illustrated in FIG. 15 for the snowboard binding illustrated in FIGS. 1 and 2;

FIG. 17 is a side elevational view of the rear binding mechanism illustrated in FIGS. 15 and 16 for the snowboard binding illustrated in FIGS. 1 and 2 in accordance with the present invention;

FIG. 18 is a diagrammatic illustration of the rear binding mechanism with the rear catch or cleat of the snowboard boot about to be coupled to the rear binding mechanism;

FIG. 19 is a further diagrammatic view of the rear binding mechanism with the rear catch of the snowboard boot contacting the catch plate of the rear binding mechanism;

FIG. 20 is a further diagrammatic view of the rear binding mechanism with the rear catch of the snowboard boot latched in a first cleat engagement or latched position;

FIG. 21 is a further diagrammatic view of the rear binding mechanism with the rear catch of the snowboard boot coupled to the rear binding mechanism in a second cleat engagement or latched position;

FIG. 22 is a further diagrammatic view of the rear binding mechanism with the rear catch of the snowboard boot coupled to the rear binding mechanism in a third cleat engagement or latched position;

FIG. 23 is a further diagrammatic view of the rear binding mechanism with the latch plate being moved to a release position and prior to movement of the catch plate from the third cleat engagement or latched position;

FIG. 24 is a further diagrammatic view of the rear binding mechanism with the latch plate in the release position and the rear catch of the snowboard boot in a position just prior to release;

FIG. 25 is a further diagrammatic view of the rear binding mechanism in the release position and with the rear catch of the snowboard boot fully disengaged from the rear binding mechanism;

FIG. 26 is a side elevational view of the first mounting member for the rear binding mechanism illustrated in FIGS. 15–17 for the snowboard binding of FIGS. 1 and 2;

FIG. 27 is a side elevational view of the second mounting member for the rear binding mechanism illustrated in FIGS. 15–17 of the snowboard binding illustrated in FIGS. 1 and 2;

FIG. 28 is an end elevational view of the protective cover for the rear binding mechanism illustrated in FIGS. 15–17 for the snowboard binding of FIGS. 1 and 2;

FIG. 29 is a top plan view of the protective cover illustrated in FIG. 28 for the rear binding mechanism illustrated in FIGS. 15–17 of the snowboard binding of FIGS. 1 and 2;

FIG. 30 is a side elevational view of the protective cover illustrated in FIGS. 28 and 29 for the rear binding mechanism illustrated in FIGS. 15–17 of the snowboard binding of FIGS. 1 and 2;

FIG. 31 is a side elevational view of the catch plate for the rear binding mechanism illustrated in FIGS. 15–17 of the snowboard binding of FIGS. 1 and 2;

FIG. 32 is a side elevational view of the latch plate for the rear binding mechanism illustrated in FIGS. 15–17 of the snowboard binding of FIGS. 1 and 2;

FIG. 33 is a top plan view of the release lever for the rear binding mechanism illustrated in FIGS. 15–17 of the snowboard binding of FIGS. 1 and 2;

FIG. 34 is a side elevational view of the engagement end of the release lever illustrated in FIG. 33 for the rear binding mechanism illustrated in FIGS. 15–17 of the snowboard binding of FIGS. 1 and 2;

FIG. 35 is an end axial view of the engagement end of the release lever illustrated in FIGS. 33 and 34 for the rear binding mechanism illustrated in FIGS. 15–17 of the snowboard boot binding of FIGS. 1 and 2;

FIG. 36 is a bottom perspective view of the snowboard boot illustrated in FIG. 1 in accordance with the present invention;

FIG. 37 is a bottom plan view of the mid sole with the front and rear catches coupled thereto in accordance with the present invention;

FIG. 38 is a partial front elevational view of the toe section of the mid sole and the front catch with part of the mid sole shown in cross-section for purposes of illustration;

FIG. 39 is a partial rear elevational view of the heel section of the mid sole and the rear catch with part of the mid sole shown in cross-section for purposes of illustration;

FIG. 40 is a top plan view of the front catch for the snowboard boot illustrated in FIG. 36;

FIG. 41 is a front elevational view of the front catch illustrated in FIG. 40 for the snowboard boot illustrated in FIG. 36;

FIG. 42 is a bottom plan view of the front catch illustrated in FIGS. 40 and 41 for the snowboard boot illustrated in FIG. 36;

FIG. 43 is a cross-sectional view of the front catch illustrated in FIGS. 40–42 as seen along sectional line 43—43 of FIG. 42;

FIG. 44 is an axial end view of one of the fasteners for the front catch of the snowboard boot illustrated in FIG. 36;

FIG. 45 is a side elevational view of the fastener illustrated in FIG. 44 for securing the front catch to the snowboard boot illustrated in FIG. 36;

FIG. 46 is an opposite axial end view of the fastener illustrated in FIGS. 44 and 45 for attaching the front catch to the snowboard boot illustrated in FIG. 36;

FIG. 47 is an axial end view of one of the cleat nuts for the front and rear catches of the snowboard boot illustrated in FIG. 36;

FIG. 48 is a side elevational view of the cleat nut illustrated in FIG. 47 for attaching the front and rear catches to the snowboard boot illustrated in FIG. 36;

FIG. 49 is an opposite axial end view of the cleat nut illustrated in FIGS. 47 and 48 for attaching the front and rear catches to the snowboard boot illustrated in FIG. 36;

FIG. 50 is a cross-sectional view of the cleat nut illustrated in FIGS. 47–49 as seen along section line 50—50 of FIG. 49;

FIG. 51 is a top plan view of the rear catch or cleat for the snowboard boot illustrated in FIG. 36;

FIG. 52 is a side elevational view of the rear catch illustrated in FIG. 51 for the snowboard boot illustrated in FIG. 36;

FIG. 53 is a side elevational view of the rear catch illustrated in FIGS. 2 51 and 52 for the snowboard boot illustrated in FIG. 36;

FIG. 54 is a partial, exploded perspective view of a portion of a snowboard with a snowboard binding coupled thereto and a snowboard boot about to be coupled to the snowboard binding in accordance with a second embodiment of the present invention;

FIG. 55 is a top plan view of the base member of the snowboard binding illustrated in FIG. 1 in accordance with the present invention;

FIG. 56 is a top plan view of the rear abutment section of the snowboard binding illustrated in FIG. 1;

FIG. 57 is a top plan view of the front abutment section of the snowboard binding illustrated in FIG. 1;

FIG. 58 is a partial exploded side elevational view the front binding member with the front portion of the base member shown in cross-section for the purpose of illustration;

FIG. 59 is an exploded side elevational view of the rear binding member or mechanism with the rear portion of the base member shown in cross-section for the purpose of illustration;

FIG. 60 is a top plan view of a base member of a snowboard binding in accordance with a third embodiment of the present invention;

FIG. 61 is an exploded side elevational view of the rear binding member of a snowboard binding in accordance with the third embodiment of the present invention, with the rear portion of the base member shown in cross-section as viewed along section line 61—61 of FIG. 60;

FIG. 62 is an exploded side elevational view of the front binding member or mechanism in accordance with the third embodiment of the present invention, with the front portion of the base member shown in cross-section as viewed along section line 61—61 of FIG. 60; and FIG. 63 is a bottom plan view of the mid sole a snowboard boot with the front and rear catches coupled thereto in accordance with the third embodiment of the present invention.

DETAILED DESCRIPTION OF THE PREFERRED EMBODIMENTS

Referring initially to FIG. 1, a snowboard binding system 10 is illustrated in accordance with the first embodiment of the present invention. The snowboard binding system 10 basically includes a snowboard binding 12 and a snowboard boot 14. The snowboard binding 12 is attached to the top or upper surface of a snowboard 16 via an adjustment disk 18 and a plurality of fasteners or screws 20. The longitudinal axis of the snowboard 16 is represented by a centerline X in FIG. 1. The longitudinal axis of the snowboard binding 12 is represented by a centerline Y, while the longitudinal axis of the snowboard boot 14 is represented by a centerline Z in FIG. 1. The snowboard binding 12 is preferably adjustably coupled to the snowboard 16 via the adjustment disk 18 in a conventional manner. In particular, the snowboard binding 12 is angularly adjustable relative to the adjustment disk 18 and the snowboard 16 by loosening the fasteners 20. Of course, the snowboard binding 12 could be attached directly to the snowboard 16, as needed and/or desired.

It would be apparent to those skilled in the art from this disclosure that two snowboard binding systems 10 utilized in conjunction with the snowboard 16 such that the rider has both feet attached to the snowboard 16. For the sake of brevity, only a single snowboard binding system 10 will be discussed and/or illustrated herein. Moreover, it should be appreciated by those skilled in the art from this disclosure that the attachment of the snowboard binding 12 to the snowboard 16 can be accomplished in any number of ways. In other words, while this disclosure explains a preferred mechanism (i.e., the adjustment disk 18 and screws 20) for attaching snowboard binding 12 to the snowboard 16, the present invention is not limited to any particular implementation.

Referring now to FIGS. 1 and 2, the snowboard binding 12 basically includes a base member 22, a front binding member or mechanism 24, a rear binding member or mechanism 26, a heel cup 28 and a high back 30. The heel cup 28 and the high back 30 are preferably adjustably coupled to the base member 22 in a conventional manner such that the high back 30 applies a forward leaning force on the snowboard boot 14, when coupled to the snowboard binding 12. Thus, the heel cup 28 and the high back 30 are relatively conventional and will not be discussed and/or illustrated in detail herein.

Figure 4:
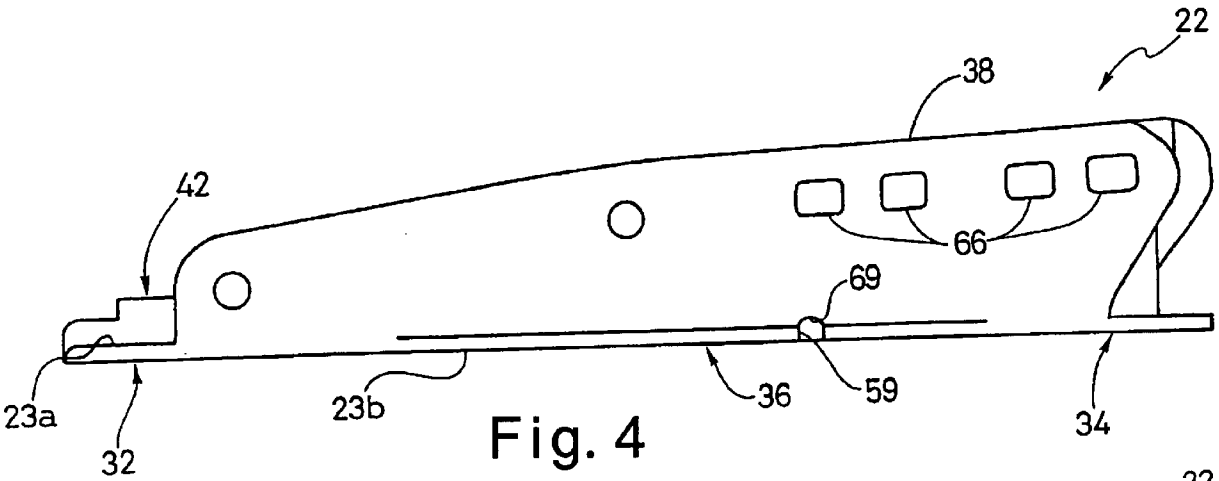
FIG. 4 is a side elevational view of the base member illustrated in FIG. 3 for the snowboard binding illustrated in FIGS. 1 and 2.
Figure 5:
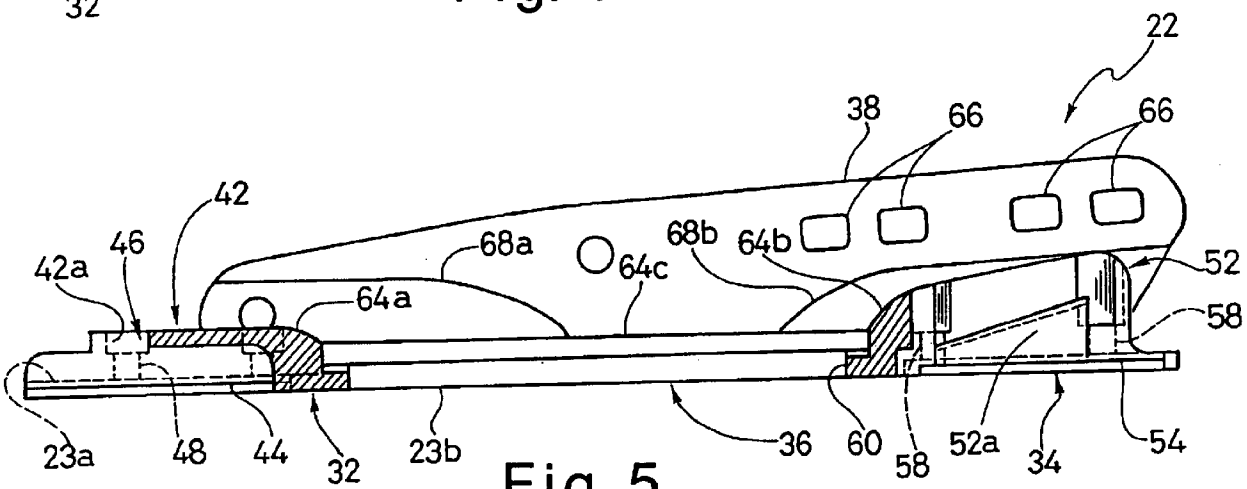
FIG. 5 is a longitudinal cross-sectional view of the base member illustrated in FIGS. 3 and 4 for the snowboard binding illustrated in FIGS. 1 and 2 as seen along section line 5—5 of FIG. 3.

The base member 22 basically includes a front portion 32, a rear portion 34, a central portion 36 arranged between the front and the rear portions 32 and 34, and a pair of side attachment members or portions 38, as best seen in FIGS. 3–5. Preferably, the base member 22 also includes a rib structure 40 integrally formed with the base member 22. The rib structure 40 extends upwardly from the base member 22 to effectively increase the thickness of the base member 22 as explained below.

Preferably, the front portion 32, the rear portion 34, the central portion 36, the side attachment portion 38 and the rib structure 40 are integrally formed together as a one-piece unitary member of a relatively light weight rigid material such as a metallic material. For example, the base member 22 can be constructed of aluminum or an aluminum alloy. In this embodiment, the base member 22 is preferably made by casting as a one-piece unitary member. Of course, the base member 22 can be made of several pieces with the main body of the base member 22 being formed by stamping and bending as in a later embodiment. In an alternate embodiment, the base member 22 is preferably formed by bending a metal sheet material. However, it would be apparent to those skilled in the art from this disclosure, that the base member 22 could be constructed using any suitable manufacturing techniques, and be constructed of any suitable hard rigid materials such as various metals as well as a hard plastic, carbon, or a metal/carbon combination.

The longitudinal centerline Y of the snowboard binding 12 extends between the front and the rear portions 32 and 34 of the base member 22. The base member 22 also preferably includes an upper surface 23*a* and a lower surface 23*b*. The lower surface 23*b* is substantially parallel to the upper surface 23*a*.

Referring now to FIGS. 3, 5, 6 and 9, the front portion 32 of the base member 22 basically includes a front rib or abutment section 42, a front recess 44, and a front slot 46. The front abutment section 42 laterally supports the front binding member 24. The front abutment section 42 forms a part of the rib structure 40, which extends upwardly from the upper surface 23*a* of the front portion 32. The front recess 44 and the front slot 46 are configured to fixedly couple the front binding member or mechanism 24 to the front portion 32 of the base member 22. The front abutment section 42 extends upwardly from the upper surface 23*a* to substantially surround the front slot 46.

Basically, the front slot 46 divides the front abutment section 42 at a front end into a pair of laterally spaced front abutment surfaces 42*a* and 42*b* that are at least partially disposed above a top attachment surface of the central attachment area. The front abutment surfaces 42*a* and 42*b* located on the lateral sides of the front slot 46 are preferably step-shaped. In other words, the upper surface of the front abutment section 42 is preferably step-shaped at the front end thereof. Thus, the upper surface of the front abutment section 42 is preferably spaced about 12.0 millimeters from the lower surface 23*b* of the base member 22, except at the front step area where the upper surface of the front abutment section 42 is preferably spaced about 8.0 millimeters from the lower surface 23*b* of the base member 22. This arrangement creates a cleat receiving area which is configured to receive a part of the snowboard boot 14 therein. Thus, when the front binding member or mechanism 24 is fixedly coupled to the front portion 32, a portion of the snowboard boot 14 can be coupled to the snowboard binding 12, as discussed below in more detail.

Figure 6:
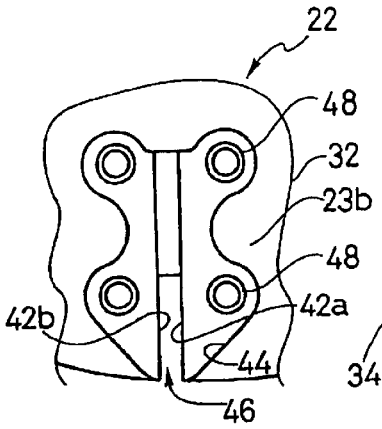
FIG. 6 is a partial bottom plan view of a front portion of the base member illustrated in FIGS. 3–5 for the snowboard binding illustrated in FIGS. 1 and 2.
Figure 7:
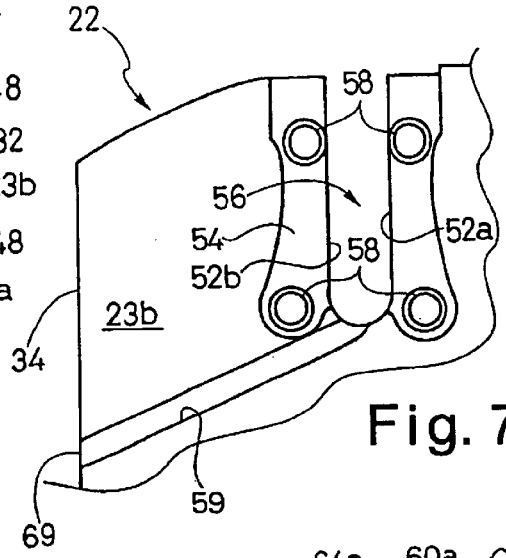
FIG. 7 is a partial bottom plan view of a rear portion of the base member illustrated in FIGS. 3–6 for the snowboard binding illustrated in FIGS. 1 and 2.
Figure 8:
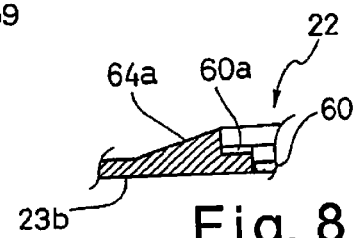
FIG. 8 is a partial cross-sectional view of an inner portion of the central rib section of the base plate illustrated FIGS.

The front recess 44 preferably has a thickness that corresponds to a portion of the front binding member or mechanism 24. Moreover, the front recess 44 preferably has a shape that corresponds or at least substantially corresponds to the shape of a portion of the front binding member 24, as viewed from below (FIG. 6). In other words, even when the front binding member 24 is not yet fixedly coupled to the base member 22, the front binding member 24 is preferably prevented from lateral and longitudinal movement relative to the front portion 32 of the base member 22. Furthermore, the portion of the front binding member 24 received in the front recess 44 is preferably parallel to the bottom surface 23*b* when mounted therein.

Preferably, a plurality (four) of stepped through holes 48 are formed in the front abutment section 42 so as to be aligned with holes of the front binding member 24 when the front binding member 24 is mounted in the front recess 44 and the front slot 46, as also discussed below in more detail. More specifically, the holes 48 are preferably arranged such that two of the holes 48 are arranged on one side of the longitudinal centerline Y, while the other two of the holes 48 are arranged on the opposite side of the longitudinal centerline Y.

Referring to FIGS. 3, 5, 7 and 10, the rear portion 34 of the base member 22 basically includes a rear rib or abutment section 52, a rear recess 54, and a rear slot 56. The rear abutment section 52 extends upwardly from the rear portion 34 of the base member 22 to laterally support the rear binding member or mechanism 26. The rear portion 34 of the base member 22 is similar to the front portion 32, except that the rear slot 56 is substantially wider than the front slot 46 in order to accommodate parts of rear binding member or mechanism 26. The front and rear slots 46 and 56 are longitudinally extending slots that are substantially parallel to the longitudinal axis Y of the base member 22. Moreover, the rear slot 56 is also preferably longer in the longitudinal direction than the front slot 46 in order to accommodate parts of the rear binding mechanism 26. Specifically, the rear slot 56 is preferably about 12.0 millimeters wide, while the front slot 46 is preferably about 4.0 millimeters wide.

The rear abutment section 52 is also similar to the front abutment section 42, except that the rear abutment section 52 is inclined relative to the upper and lower surfaces 23*a* and 23*b* of the base member 22. Moreover, the rear abutment section 52 has an upper surface that is spaced upwardly from the lower surface 23*b* of the base member 22. The inclined upper surface of the rear abutment section 52 is preferably spaced between about 16.0 millimeters and about 22.0 millimeters from the lower surface 23*b* of the base member 22. The rear abutment section 52 preferably has curved transition between the inclined upper surface thereof and the other portions of the rear abutment section 52.

The rear slot 56 divides the rear abutment section 52 at a rear end into a pair of laterally spaced rear abutment surfaces 52*a* and 52*b* that are at least partially disposed above a top attachment surface of the central attachment area. The rear abutment surfaces 52*a* and 52*b* are arranged on the opposite lateral sides of the center longitudinal axis Y. The rear abutment section 52 includes a plurality (four) of rear holes 58 for attaching parts of the rear binding mechanism 26. Similar to the front portion 32 of the base member 22, the rear holes 58 are preferably step-shaped such that they are configured to receive fasteners of the rear binding mechanism 26. More specifically, the holes 58 are preferably arranged such that two of the holes 58 are arranged on one side of the longitudinal centerline Y, while the other two of the holes 58 are arranged on the opposite side of the longitudinal centerline Y.

The rear recess 54 is similar to the front recess 44 in that it is shaped to receive a part of the rear binding mechanism 26 to prevent lateral and longitudinal movement of the rear binding mechanism 26. Also, the rear recess 54 has a thickness corresponding to a thickness of part of the rear binding mechanism 26 that is received therein such that this part of the rear binding mechanism 26 is parallel to the lower surface 23*b* of the base member 22, as discussed below in more detail.

Turning now to FIGS. 1–3, 5 and 8, the center portion 36 of the base member 22 basically includes a center attachment opening 60 and a central rib section 62. The central attachment opening 60 is configured to receive the adjustment disk 18 in a conventional manner to adjustably couple the base member 22 to the snowboard 16. Thus, the central portion 36 of the base member 22 includes a central attachment area with the central attachment opening 60 formed therein.

The central rib section 62 substantially surrounds the center attachment opening 60, and is arranged between the front and rear abutment sections 42 and 52. The central rib section 62 extends upwardly from the upper surface 23*a* of the base member 22. In other words, the central rib section 62 includes an upper surface that is spaced above a serrated top attachment surface 60*a* of the central attachment area that defines the central attachment opening 60 and that is spaced above the upper surface 23*a* of the base member 22. Specifically, the central rib section 62 includes an inclined front transitional rib element 64*a* that extends around a front area of the center attachment opening 60. Similarly, an inclined rear transitional rib element 64*b* extends around the rear area of the center attachment opening 60. Finally, two lateral side rib elements 64*c* are arranged on opposite lateral sides of the center attachment opening 60 and extend forward-rearward between the front transitional rib element 64*a* and the rear transitional rib element 64*b*.

The lateral side rib elements 64*c* preferably have planar upper surfaces that are spaced about 9.0 millimeters from the lower surface 23*b* of the base member 22. The inclined transitional rib elements 64*a* and 64*b* preferably extend downwardly from the lateral side rib elements 64*c* to the upper surface 23*a* of the base member 22. Moreover, the transitional rib elements 64*a* and 64*b* preferably also extend upwardly to the front and rear rib sections 42 and 52, respectively. Thus, the upper surface of the central rib section 62 is preferably closer to the upper surface 23*a* than the uppermost portion of the upper surface of the front rib section 42 and the entire upper surface of the rear rib section 52. Moreover, the rear abutment section 52 preferably extends upwardly further from the upper surface 23*a* than the front abutment section 42. Thus, a multi-stepped, undulating rib structure 40 is formed by the front abutment section 42, the rear abutment section 52 and the central rib section 62. Not only is the rib structure 40 multi-stepped, the rib structure 40 also includes the inclined upper surfaces of the transitional rib elements 64*a* and 64*b*, and the curved transitional area between the rib elements 64*a* and 64*b* and the front and rear rib sections 42 and 52. The rib structure 40 is preferably configured to selectively contact parts of the snowboard boot 14. The rib structure 40 is also preferably integrally formed with the base member 22 as a one-piece unitary member. The configuration of the rib structure 40 increases the strength/rigidity of the base member 22 while also contributing to a low profile of the snowboard binding system 10.

Each of the side attachment portions 38 preferably includes a plurality of attachment holes 66, a first (front side) rib element 68*a* and a second (rear side) rib element 68*b*. Furthermore, one of the side attachment portions 38 includes an opening 69 in communication with a cutout or recess 59 of the base member 22 such that a part of the rear binding mechanism 26 can be received therethrough. The side attachment portions 38 preferably extend at substantially right angles relative to the upper and lower surfaces 23*a* and 23*b* of the base member 22. However, the first and second side rib elements 68*a* and 68*b* of each side attachment portion 38 protrude inwardly toward the center longitudinal axis Y to effectively decrease the effective width of the area arranged between the side attachment portions 38. These first and second side rib elements 68*a* and 68*b* are arranged and configured to contact the sides of the snowboard boot 14 at the ball section of the snowboard boot 14 and the heel section of the snowboard boot 14, respectively to securely hold the boot 14 from moving laterally side to side. Thus, even if there is lateral play between the front and rear binding members 24 and 26, and the front and rear catches 146 and 148 (e.g. due to the lateral dimensions of these parts), the boot will not move laterally side to side. Moreover, these first and second side rib elements 68*a* and 68*b* reinforce the base member 22 for increased strength.

The heel cup 28 is coupled to the side attachment portions 38 in a conventional manner using the holes 66. Due to the arrangement of the holes 66, the heel cup 28 is preferably adjustably coupled to the base member 22. Similarly, the high back 30 is coupled to the heel cup 28 in a conventional manner, as mentioned above. The heel cup 28 and the high back 30 are not critical to the present invention. Accordingly, the heel cup 28 and the high back 30 will not be discussed in further detail herein.

Referring now to FIGS. 11–14, the front binding member or mechanism 24 will now to be discussed in more detail. As mentioned above, the front binding member 24 is coupled to the base member 22 at the front portion 32 of the base member 22. The front binding member 22 is arranged and configured to selectively engage a front cleat 146, discussed below, of the snowboard boot 14.

Specifically, the front binding member 24 is fixedly coupled to the lower surface of the front portion 32 of the base member 22 at the front recess 44 and the front slot 46 that are formed in the front abutment section 42. More specifically, the front binding member 24 basically includes a front attachment plate 70, a front binding plate 72 and a non-movable front claw 74. When the front binding member 24 is secured to the base member 22, the front claw 74 is non-movably retained on the base member 22 with the front claw 74 extending upwardly above the front abutment section 42. The front claw 74 and the binding plate 74 define a cleat receiving slot 77 that is dimensioned to hold the front catch 146 temporarily (e.g. against longitudinal movement and vertical movement) even if a rear catch 148, discussed below, of the snowboard boot 14 is not engaged with the rear binding mechanism 26.

Preferably, the front binding member 24 is formed of two (first and second) front binding pieces 24*a* and 24*b* that are mirror images of each other. The (first) front binding piece 24*a* includes a front attachment section 71*a*, a front binding section 73*a* and a front claw section 75*a*, while the (second) front binding piece 24*b* includes a front attachment section 71*b*, a front binding section 73*b* and a front claw section 75*b*. This front binding arrangement permits each of the front binding pieces 24*a* and 24*b* of the front binding member 24 to be formed by bending in order to create a substantially L-shaped member as seen along the longitudinal axis Y. Each of the front binding pieces 24*a* and 24*b* of the front binding member 24 is preferably constructed of a hard rigid material such as a metallic material. Preferably, each of the front binding pieces 24*a* and 24*b* of the front binding member 24 is constructed by first creating a flat piece with the desired shape by machining, casting or punching a piece of sheet material such as sheet metal. Then, the piece is bent to have the shape as best shown in FIGS. 12–14.

Each of the front binding pieces 24*a* and 24*b* of the front binding member 24 includes two tapered through holes 76*a* or 76*b*, respectively, that are configured to be aligned with the front holes 48 of the front portion 32. Thus, four fasteners 78 are utilized to fixedly couple the front binding pieces 24*a* and 24*b* of the front binding member 24 to the front portion 32. In illustrated embodiment, each of the fasteners 78 preferably includes a nut and a bolt that are utilized to replaceably couple the front binding member 24 to the base member 22.

Because the front binding member 24 is preferably constructed of two pieces, the attachment sections 71*a* and 71*b* together preferably form the attachment plate 70, while the binding sections 73*a* and 73*b* together preferably form the binding plate 72. Similarly, the front claw sections 75*a* and 75*b* together preferably form the front claw 74. Each of the front binding pieces 24*a* and 24*b* of the front binding member 24 is preferably about 2.0 millimeters thick. Accordingly, when the binding sections 73*a* and 73*b* contact each other and the front claw sections 75*a* and 75*b* contact each other, the vertically extending front binding plate 72 is formed with a thickness of about 4.0 millimeters. Similarly, when the front claw sections 75*a* and 75*b* contact each other, the front claw 74 is formed with a thickness of about 4.0 millimeters.

The thickness of the front binding plate 72 of the front binding member 24 substantially corresponds to the width of the front slot 46 of the base member 22. Thus, the front binding member 24 is secured against lateral movement by the front abutment surfaces 42*a* and 42*b* of the front abutment section 42. The binding plate 72 (the front attachment section 71*a* and 71*b*) of the front binding member 24 has a peripheral surface with a shape that corresponds to the peripheral shape of the front recess 44. Thus, when the front binding member 24 is coupled to the base member 22 by the fasteners 78, the front binding member 24 is secured against lateral and longitudinal movement relative to the base member 22.

Referring now to FIGS. 15–17, 26 and 27 the rear binding member or mechanism 26 will now to be discussed in more detail. The rear binding mechanism 26 basically includes a mounting member 80 (first and second mounting members 80*a* and 80*b*), a catch member or plate 82, a latch member or plate 84, a biasing member 86, a release lever 88 and a protective cover 89. The biasing member 86 basically includes a first biasing pin 86*a*, a second biasing pin 86*b* and a pair of coiled tension springs 86*c*. Basically, the rear binding mechanism 26 is fixedly coupled to the base member 22 at the rear portion 34 of the base member 22. The rear binding mechanism 26 is arranged and configured at the rear portion 34 of the base member 22 to selectively engage the rear cleat 148 of the snowboard boot 14, as discussed below.

More specifically, the rear binding mechanism 26 is fixedly coupled to the rear abutment section 52 of the base member 22 such that the rear binding mechanism 26 is laterally supported by the rear abutment section 52. The mounting members 80*a* and 80*b* are fixedly coupled to the rear portion 34 within the rear recess 54 and the rear slot 56 that are formed in the rear portion 34 of the base member 22 and the rear abutment section 52. Specifically, four of the fasteners 78 are utilized to fixedly couple the mounting members 80*a* and 80*b* of the rear binding member 26 to the rear portion 34. In illustrated embodiment, each of the fasteners 78 preferably includes a nut and a bolt that are utilized to replaceably couple the rear binding member 26 to the base member 22.

Referring now to FIGS. 18–25, the catch plate 82 is pivotally mounted to and laterally supported by the mounting members 80*a* and 80*b* for rotation about a catch pivot axis A, while the latch plate 84 is also pivotally mounted to and laterally supported by the mounting member 80*a* and 80*b* for rotation about a latch pivot axis B. The biasing member 86, as seen in FIGS. 16 and 17, normally biases the latch plate 84 to engage the catch plate 82 to selectively retain the catch plate 82 in a plurality of positions. The release lever 88, as seen in FIGS. 1, 16 and 17, is coupled to the latch member 84 to move the latch plate 84 against the biasing force of the biasing member 86 so that the latch plate 84 moves out of engagement with the catch plate 82.

Referring now to FIGS. 16, 26 and 27, the mounting members 80*a* and 80*b* are preferably L-shaped members as seen along centerline Y and preferably mirror images of each other. Each of the mounting members 80*a* and 80*b* is preferably constructed of a hard rigid material such as a metallic material. Preferably, each of the mounting members 80*a* and 80*b* is formed as a flat plate member by machining, casting or punching a sheet material such as a sheet metal. Preferably, the flat shape is then bent into the L-shape shape of the mounting members 80*a* and 80*b* illustrated in FIGS. 16, 17, 26 and 27. Each of the mounting members 80*a* and 80*b* is preferably about 2.0 millimeters thick.

The mounting members 80*a* and 80*b* form a rear attachment plate 90, an upwardly extending rear binding plate 92 and a stationary guide member 94. In particular, the mounting member 80*a* includes an attachment section 90*a*, a binding section 92*a* and a guide section 94*a*, while the mounting member 80*b* includes an attachment section 90*b*, a binding section 92*b* and a guide section 94*b*. The attachment sections 90*a* and 90*b* form the rear attachment plate 90. The binding sections 92*a* and 92*b* form the rear binding plate 92. The guide sections 94*a* and 94*b* form the stationary guide member 94.

The rear attachment plate 90 is received in the rear recess 54 formed in the lower surface 23*b* of the base member 22 at the rear abutment section 52. The upwardly extending rear binding plate 92 is disposed in the rear slot 56 of the rear abutment section 52 to form a space between the binding sections 92*a* and 92*b*. The laterally spaced rear abutment surfaces 52*a* and 52*b* laterally support the rear binding mechanism 26. In particular, the laterally spaced rear abutment surfaces 52*a* and 52*b* directly laterally support the rear binding mechanism 26 through selective contact with certain parts thereof, as explained below more detail. Alternatively, the rear binding plate 92 formed by the binding sections 92*a* and 92*b* can optionally be considered part of the base member 22 when fixedly coupled to the base member 22 such that the binding sections 92*a* and 92*b* have laterally spaced abutment surfaces that directly laterally support certain movable parts (e.g. the catch plate 82 and the latch plate 84) of the rear binding mechanism 26 on opposite lateral sides thereof, as explained below in more detail.

The stationary guide member 94 extends upwardly from the rearward edges of the attachment sections 90*a* and 90*b*. Thus, the stationary guide member 94 is fixedly coupled to the base member 22 and extends perpendicularly relative to the upper surface 23*a* of the base member 22. In particular, the stationary guide member 94 is fixed to the base member 22 to form a cleat insertion opening between the catch member 82 and the stationary guide member 94.

Each of the guide sections 94*a* and 94*b* of the stationary guide member 94 includes a vertical portion that forms a vertical stop section 95 and an inclined portion that forms a tapered section 97. The vertical stop section 95 is spaced rearwardly from the catch member 82 that is pivotally coupled between the binding section 92*a* and 92*b*. Thus, the vertical stop section 95 is spaced rearwardly from the catch member 82 to form the cleat insertion opening between the catch member 82 and the stationary guide member 94 to prevent rearward longitudinal movement of the rear catch 148. In other words, the vertical stop section 95 has a pair of stop surfaces or elements formed by the guide sections 94*a* and 94*b* to hold the rear catch 148 of the snowboard boot 14 in the cleat insertion opening formed between the catch member 82 and the stationary guide member 94. The tapered section 97 selectively guides the rear catch 148 during an engagement of the rear catch 148 with the rear binding mechanism 26.

The tapered section 97 of the stationary guide member 94 is located at an upper free end of the stop section 95. The tapered section 97 is inclined upwardly and rearwardly from the stop section 95 to from a pair of guide surfaces for guiding the rear catch 148 into the cleat insertion opening between the catch member 82 and the stationary guide member 94 when the rear catch 148 contacts the tapered section 97. In particular, the bight or cross portion of the rear catch 148, discussed below, selectively contacts the tapered section 97. Thus, the rear catch 148 of the snowboard boot 14 engages the catch member 82 by downward insertion of the rear catch 148 of the snowboard boot 14 into the cleat insertion opening between the catch member 82 and the stationary guide member 94.

The attachment sections 90*a* and 90*b* include a plurality of attachment holes 96*a* and 96*b*, respectively, for fixedly coupling the mounting members 80*a* and 80*b* to the base member 22. Specifically, the attachment section 90*a* includes a pair of attachment holes 96*a* that are tapered through holes, while the attachment section 90*b* includes a pair of attachment holes 96*b* that are tapered through holes.

The binding sections 92*a* and 92*b* have a plurality of holes or openings for coupling the catch plate 82, the latch plate 84, and the release lever 88 therebetween. The binding section 92*a* includes a catch pin hole 98*a*, a biasing pin slot 99*a*, a latch pin hole 100*a* and a biasing pin slot 101*a*, while the binding section 92*b* includes a catch pin hole 98*b*, a biasing pin slot 99*b*, a latch pin hole 100*b* and a biasing pin slot 101*b*. The catch pin holes 98*a* and 98*b* are preferably aligned with each other and have the catch pivot axis A passing through their centers. Similarly, the binding holes 100*a* and 100*b* are preferably aligned with each other and have the latch pivot axis B passing through their center. The biasing pin slots 99*a* and 99*b* are axially aligned with the first biasing pin 86*a* supported therein when the catch plate 82 is in certain positions. The biasing pin slots 101*a* and 101*b* are also preferably aligned with each other, but have the second biasing pin 86*b* supported therein. When the mounting members 80*a* and 80*b* are fixedly coupled to the base member 22, the binding sections 92*a* and 92*b* are preferably laterally spaced apart relative to each other within the rear slot 56 to form a space therebetween for receiving the catch plate 82 and latch plate 84.

The catch pin holes 98*a* and 98*b* support a catch pivot pin 102, while the latch pin holes 100*a* and 100*b* support a latch pivot pin 104. The catch pivot pin 102 is retained within the catch pin holes 98*a* and 98*b* by a pair of clips 103 such as e-clips or c-clips received in annular grooves formed at each end of the pivot pin 102. The latch pivot pin 104 is retained in the latch pin holes 100*a* and 100*b* by a similar pair of clips 105 such as e-clips or c-clips received in annular groove formed at the opposite ends of the latch pivot pin 104. The catch plate 82 is pivotally mounted on the catch pivot pin 102 between the binding sections 92*a* and 92*b*. Similarly, the latch plate 84 is pivotally mounted on the latch pivot pin 104 between the binding sections 92*a* and 92*b*. The pivot pins 102 and 104 each preferably have a length of about 11.6 millimeters. Thus, the pivot pins 102 and 104 are preferably only slightly smaller than the 12.0 millimeter wide rear slot 56. Accordingly, the laterally spaced rear abutment surfaces 52*a* and 52*b* selectively contact the ends of the pivot pins 102 and 104 to laterally support the rear binding mechanism 26. The pivot pins 102 and 104 in turn laterally support the mounting members 80*a* and 80*b* of the rear binding mechanism 26.

As best seen in FIG. 31, the catch member or plate 82 basically includes a pivot hole 110, a control hole 112, a cleat or catch receiving recess 114 and three locking notches 115, 116 and 117. The pivot hole 110 receives the catch pivot pin 102 therethrough so that the catch plate 82 pivots about the catch pivot pin 102. The control hole 112 receives the biasing pin 86*a* therein for coupling the springs 86*c* to the catch plate 82, as discussed below in more detail. The cleat receiving recess 114 is designed to receive and hold the rear catch 148 of the snowboard boot 14, as also discussed below in more detail. The catch plate 82 is preferably about 4.0 millimeters thick. The catch plate 82 can be constructed as a one-piece plate, as illustrated in the drawings, or can be constructed of two identical plate pieces with each of the two pieces being about 2.0 millimeters thick. In any case, each piece of the catch plate 82 preferably has the shape illustrated in FIG. 31.

Due to the arrangement of the control hole 112 relative to the pivot hole 110, the catch plate 82 is normally biased in a counter-clockwise direction as seen in FIGS. 18–27. However, the latch plate 84 is configured to selectively engage the locking notches 115, 116 and/or 117 when the rider steps into the snowboard binding 12 such that the catch plate 82 can be locked in a plurality (three) of latched positions.

As best seen in FIG. 32, the latch member or plate 84 basically includes a pivot hole 120, a control hole 122, a first catch engagement tooth 124, a second catch engagement tooth 126 and a release notch 128. The pivot hole 120 receives the latch pivot pin 104 therethrough. The control hole 122 receives the biasing pin 86*b* therein for coupling the springs 86*c* to normally bias the latch plate 84 in the clockwise direction as seen in FIGS. 18–27. The first engagement tooth 124 is configured to selectively engage the locking notches 115, 116 and/or 117 of the catch plate 82 to hold the catch plate 82 in three different latched positions. The latch plate 84 is also preferably about 4.0 millimeters thick. The latch plate 84 can be constructed as a one-piece plate, as illustrated in the drawings, or can be constructed of two identical plate pieces with each of the two pieces being about 2.0 millimeters thick. In any case, each piece of the latch plate 84 preferably has the shape illustrated in FIG. 31.

The second engagement tooth 126 is designed to hold the catch plate 82 in a fourth position. Specifically, when the latch member is in one of the latched positions and the rider wishes to remove the snowboard boot 14 from the snowboard binding 12, the release lever 88 is moved to rotate the latch plate 84 in the counter-clockwise direction against the biasing force of the springs 86*c*. This pivoting moves the first engagement tooth 124 into a spaced relationship from the locking notches 115, 116 and 117 of the catch plate 82. Thus, the catch plate 82 will rotate in the counter-clockwise direction due to the biasing force of the springs 86*c* until the second engagement tooth 126 engages the locking notch 115 to retain the catch plate 82 in the fourth position. When, the catch plate 82 is in the fourth position, the first catch engagement tooth 124 is circumferentially spaced in the clockwise direction from the locking notch 117. Thus, in this fourth position, the first catch engagement tooth 124 allows rotation of the catch plate 82 even when the release lever 88 is released so the first tooth 124 contacts the catch plate 82. This can be considered a so-called rest or release position for the rear binding mechanism 26. When the rider steps into the snowboard binding 12, the catch member or plate 82 is preferably arranged in the fourth rest or release position. However, as the rider steps down the rear cleat 148 of the snowboard boot 14 is received in the cleat receiving recess 114 of the catch plate 82. The downward force applied by the rider causes the catch plate 82 to rotate in the clockwise direction to one of the first, second or third latched positions. In other words, the first catch engagement tooth 124 and the locking notches 115, 116 and 117 are designed such that the catch plate 82 can rotate in the clockwise direction from the fourth position to one of the first, second and third positions against the biasing force of the springs 86*c* when the rear cleat 148 applies a force on the cleat receiving recess 114 sufficient to overcome the biasing force of the springs 86*c*. However, after the catch plate 82 is rotated from the fourth position to the first through third positions and the force from the rear cleat 148 is no longer sufficient to overcome the biasing force of the springs 86*c*, the first catch engagement tooth 124 will engage one of the locking notches 115, 116 or 117 to retain the catch plate 82 in the corresponding position due to the biasing force of the springs 86*c* (i.e., to prevent counter-clockwise movement of the catch plate 82). Thus, the rear part of the snowboard boot 14 will be coupled to the snowboard binding 12.

The release notch 128 of the latch plate 84 receives a part of the release lever 88 therein. Thus, when the rider moves the release lever 88 to a release position, the latch plate 84 will be rotated in the counter-clockwise direction against the biasing force of the springs 86*c* to move the first engagement tooth 124 out of engagement with the respective locking notches 115, 116 or 117. Therefore, the rider can then release the snowboard boot 14 from the snowboard binding 12 by lifting the rear portion (i.e., the rear cleat 148) of the snowboard boot 14. In other words, the catch plate 82 can now rotate in the counter-clockwise direction such that the cleat receiving recess 114 moves upwardly to release the snowboard boot 14 because the first tooth is no longer engaged with any of the locking notches 115, 116 or 117.

The biasing pin 86*a* is mounted in the control hole 112 of the catch plate 82. The biasing pin 86*b* is mounted in the control hole 122 of the latch plate 84 and is received through the biasing slots 101*a* and 101*b* of the binding sections 92*a* and 92*b*. The biasing pin 86*b* is sized to move along the arc of the binding slots 101*a* and 101*b* while the biasing pin 86*a* is sized to move along the arc of the binding slots 99*a* and 99*b*. The coil springs 86*c* are mounted on opposite lateral ends of both the biasing pins 86*a* and 86*b* to bias the pins 86*a* and 86*b* toward each other. Thus, the catch plate 82 is normally biased in the counter-clockwise direction while the latch plate 84 is normally biased in the clockwise direction.

Referring now to FIGS. 33–35, the release lever 88 basically includes a handle portion 136, a control portion 138 and a pivot portion 140 arranged between the handle portion 136 and the control portion 138. The pivot portion 140 is received in the corresponding shaped cutouts 59 and 69 of the base member 22 to rotate therein. The handle portion 136 extends at a right angle to the pivot portion 140 and is designed to be moved by the rider of the snowboard 16. The control portion 138 extends from the pivot portion 140 at approximately a 115 degree angle. Moreover, the control portion 138 extends into the rear slot 56 and engages the latch plate 84. Specifically, the control portion 138 is received in the release notch 128 of the latch plate 84 to selectively move/rotate the latch plate 84 about the latch pivot pin 104. The cutouts 59 and 69 are configured to rotatably receive the pivot portion 140 of the release lever 88. The free end of the control portion 138 is designed to smoothly engage the release notch 128 of the latch plate 84. Preferably, the release lever 88 is constructed of a hard rigid material such as a metallic material. Moreover, the release lever 88 is preferably retained in the cutouts 59 and 69 due to the angled configuration of the handle portion 136 and the control portion 138.

Referring now to FIGS. 1, 15 and 28–30, the protective cover 89 is a one-piece, unitary member that is preferably made of plastic or rubber. The protective cover 89 is frictionally coupled to the rear abutment section 52 of the base member 22 to form a pocket with the rear binding mechanism 26 being substantially disposed within the pocket. The protective cover 89 has four protrusions 89*a* that are frictionally retained in the holes 58 of the rear abutment section 52 to cover the slot 56. The protective cover 89 is arranged and configured such that the latch plate 84 is completely disposed within the pocket and the catch plate 82 partially extends out of an open end of the pocket that is located at the cleat insertion opening.

Referring now to FIGS. 2 and 36–39, the snowboard boot 14 will now to be discussed in more detail. The snowboard boot 14 basically includes a sole portion or member 142, an upper portion 144, the front cleat or catch 146 and the rear cleat of catch 148. The front and rear catches 146 and 148 are coupling members that are fixedly coupled to the sole portion 142. The front and rear catches 146 and 148 are configured to be releasably coupled to the snowboard binding 12, as discussed above The snowboard boot 14 of the present invention is preferably a relatively soft or flexible snowboard boot. Soft snowboard boots are well known in the art, thus, it will not be discussed or illustrated in detail herein. Rather, the snowboard boot 14 will not be discussed or illustrated in detail herein, except as the snowboard boot 14 relates to the snowboard binding system 10 of the present invention. Typically, a soft snowboard boot has a sole portion made of a stiff rubber-like material and a flexible upper portion constructed of a variety of materials, such as plastic materials and/or synthetic materials. Thus, the upper portion 144 of the snowboard boot 14 should be somewhat flexible.

Referring again to FIGS. 1 and 36, the upper member or portion 144 of the snowboard boot 14 basically includes a foot section 144*a* that is fixedly coupled to the sole portion 142 and a leg section 144*b* that extends upwardly from the foot section 144*a*. The foot section 144*a* can be fixedly couple to the sole member using any suitable technique such as adhesive or molding or bonding of the sole portion 142 (e.g. the outer sole ) thereto. The attachment of the upper portion 144 to the sole portion 142 of the snowboard boot 14 is not critical to the present invention. Thus, it will be apparent to those skilled in the art from this disclosure that the upper portion 144 can be constructed in a conventional manner using conventional manufacturing techniques and materials. Accordingly, the upper portion 144 the will not be discussed and/or illustrated in detail herein. Moreover, this attachment between the sole portion 142 and the upper portion 144 will not be discussed and/or illustrated in detail herein.

The sole portion 142 of the snowboard boot 14 basically includes an outer sole 150 and a mid sole 152. The mid sole 152 is preferably constructed of a more rigid material than the outer sole 150. Specifically, the mid sole 152 is preferably constructed of a rigid material such as plastic, while the outer sole 150 is preferably constructed of a rigid material that is slightly more flexible than the mid sole 152 such as stiff rubber. The outer sole 150 substantially overlies the mid sole 152 and portions of the upper member 144.

As seen in FIG. 2, the front and rear catches 146 and 148 extend downwardly from the sole portion 142 and are configured to engage the front and rear binding members 24 and 26 of the snowboard binding 12, respectively. Preferably, the front and rear catches 146 and 148 are directly fixed to the mid sole 152 and the outer sole 150 overlies the mid sole 152, except for an area surrounding the front and rear catches 146 and 148. The front and rear catches 146 and 148 will be discussed in more detail below.

As seen in FIGS. 2 and 37, the mid sole 152 basically includes a toe section 154, a heel section 156 and a central section 158 arranged between the toe section 154 and the heel section 156. In any case, the mid sole 152 is preferably integrally formed as a one-piece unitary member with the front and rear catches 146 and 148 fixedly coupled thereto. The longitudinal centerline Z of the snowboard boot 14 extends between the toe section 154 and the heel section 156.

Additionally, the mid sole 152 preferably has an upper surface 153*a* and a lower surface 153*b*. The lower surface

153*b* defines the toe section 154, the heel section 156 and the central section 158. In other words, the lower surface 153*b* defines the toe section 154, the heel section 156 and the central section 158 which together form a base portion or element of the mid sole 142. Optionally, side support walls or elements (not shown) can extend upwardly from the base portion or element of the mid sole 152 to laterally and longitudinally support the rider's foot. However, this arrangement of the side support walls or elements is not critical to the present invention.

As mentioned above, the toe section 154 of the mid sole 152 is configured to have the front catch 146 coupled thereto. In particular, the toe section 154, as best seen in FIG. 38, includes a pair of laterally spaced mounting holes 160 and a pair of laterally spaced recesses 162 that form a pair of support projections 162*a* and 162*b*. The mounting holes 160 extend through the toe section 154 of the mid sole 152. The recesses 162 are designed to have parts of the front catch 146 received therein. The holes 160 and the recesses 162 are preferably aligned with each other and symmetrical relative to each other about a centerline equally spaced therebetween.

The support projections 162*a* and 162*b* are preferably integrally formed with the toe section 154 as one-piece unitary member. The support projections 162*a* and 162*b* are laterally spaced apart on opposite sides of the centerline Z of the snowboard boot 14. The mounting holes 160 are also spaced apart from each other and arranged on the outer side of the support projections 162*a* and 162*b*. Each of the support projections 162*a* and 162*b* includes a laterally facing surface corresponding in shape to the cross-sectional shape of the front catch 146. The support projections 162*a* and 162*b* are arranged and configured to secure the front coupling member or catch 146 against forward and rearward movement relative to the longitudinal axis or centerline Z of the snowboard boot 14.

As best seen in FIG. 36, the heel section 156 of the mid sole 152 preferably includes a pair of mounting holes 180 and a pair of support projections 182. The support projections 182 are preferably integrally formed with the heel section 156 as one-piece unitary member. The support projections 182 are laterally spaced apart on opposite sides of the centerline Z of the snowboard boot 14. The mounting holes 180 are also spaced apart from each other and arranged on the outer side of the support projection 182. Each support projection 182 includes a laterally facing curved surface corresponding in shape to the cross-sectional shape of the rear catch 148. The support projections 182 are arranged and configured to secure the rear coupling member or catch 148 against forward and rearward movement relative to the longitudinal axis or centerline Z of the snowboard boot 14.

As seen in FIGS. 40–43, the front catch 146 is preferably formed of a sheet material such as sheet metal that is punched or stamped and then bent to create the desired shape illustrated in the drawings. The front catch 146 includes a pair of laterally spaced mounting flanges 164 and a substantially U-shaped catch portion 166 extending downwardly from the mounting flanges 164. Thus, the U-shaped catch portion 166 includes a pair of laterally spaced leg portions extending downwardly from a bottom surface of the sole portion 142 and a bight portion extending laterally between the leg portions. The catch portion 166 forms a longitudinal through passageway that is about 28.0 millimeters wide for receiving the front claw 74. The support projections 162*a* and 162*b* are arranged and configured to secure the leg portions of the catch portion 166 of the front coupling member or catch 146 against forward and rearward movement relative to the longitudinal axis or centerline Z of the snowboard boot 14. The support projections 162*a* and 162*b* contact opposite ends of the leg portions to further secure the catch portion 166 of the front catch 146 against lateral movement relative to the longitudinal axis Z.

The size and shape of the mounting flanges 164 correspond to the size and shape of the recesses 162 formed on the toe section 154. Moreover, each of the mounting flanges 164 includes a central opening 165 that is aligned with one of the mounting holes 160 when the mounting flanges 164 are located in the recesses 162. Preferably, each of the mounting flanges 164 is fixedly coupled within one of the recesses 162 by a threaded fastener 168 and a cleat nut 170 as seen in FIG. 38.

Each fastener 168 is designed to be installed from the bottom side of the mid sole 152. As seen in FIGS. 44–46, the threaded fasteners 168 are basically conventional bolts with a threaded shaft and an enlarged head with a tapered surface. On the other hand, as seen in FIGS. 47–50, the cleat nut 170 includes an enlarged mounting plate 172 with a fastener receiving portion 174 extending therefrom. The fastener receiving portion 174 includes an internally threaded bore configured to be threadedly coupled to the shaft of the fastener 168. The enlarged mounting plate 172 includes four equally spaced holes or recesses designed to engage a tightening tool (not shown) so that the cleat nuts 170 can be rotated and/or held while the threaded fasteners 168 are rotated. The cleat nuts 170 are also designed to be used with the rear catch 148 as discussed below in more detail. In any case, a thread locking or anti-loosening compound is preferably applied to the threaded connections between the threaded fasteners 168 and the cleat nuts 170. Thus, loosening of the threaded fasteners 168 is prevented after assembly.

As seen in FIGS. 51–53, the rear catch 148 basically includes a pair of leg portions 184 and a bight or cross portion 186 extending between lower ends of the leg portions 184. Preferably, the rear catch 148 has a circular cross-sectional shape and is formed as a one-piece metal bar that is bent into the desired shape. The leg portions 184 are preferably threaded at their free ends to threadedly receive a pair of cleat nuts 170 thereon to secure the leg portions 184 within the mounting holes 180 of the heel section 156. The leg portions are space laterally to form a longitudinal through passageway that is about 44.0 millimeters wide for receiving part of the catch plate 84.

The leg portions 184 extend at right angles relative to the bight portion 186. However, curved transitional areas are arranged between the leg portions 184 and a bight portion 186. Each support projection 182 includes a laterally facing curved surface corresponding in shape to the cross-sectional shape of the rear catch 148. In other words, each support portion 182 has a circular-shaped concaved surface that faces laterally outwardly therefrom. Similarly, each support projection 182 has another circular-shaped concaved surface that faces downwardly and is configured to contact a part of the bight portion 186 of the rear catch 148. Thus, the support projections 182 support the leg portions 184 and the bight portion 186 against longitudinal movement relative to the heel section 156.

Two cleat nuts 170 are used to couple the rear catch 148 to the mid sole 152. Specifically, a thread locking or anti-loosening compound is preferably applied to the leg portions 184 and then the cleat nuts 170 are threaded onto the leg portions 184 to securely couple the rear catch 148 to the sole portion 142.

Second Embodiment

Referring now to FIGS. 54–59, a snowboard binding system 210 in accordance with a second embodiment of the present invention will now be discussed. The snowboard binding system 210 of this second embodiment basically includes a snowboard binding 212 and a snowboard boot 214. The snowboard boot 214 is identical to the snowboard boot 14 of the first embodiment. Thus, the snowboard boot 214 will not be discussed and/or illustrated in detail herein. However, the snowboard binding 212 includes a modified base member 222 in accordance with the present invention. Specifically, the modified base member 222 includes a modified front abutment section 242 and a modified rear abutment section 252. Otherwise, the snowboard binding 212 is basically identical to the snowboard binding 12 of the first embodiment. Thus, the snowboard binding 212 basically includes the modified base member 222, a front binding member or mechanism 224, a rear binding member or mechanism 226, a heel cup 228 and a high back 230. The heel cup 228 and the high back 230 are identical to the heel cup 28 and the high back 30, respectively of the first embodiment. The front and rear binding members or mechanism 224 and 226 are identical to the front and rear binding members 24 and 26 of the first embodiment, except they are mounted in a modified manner due to the modified front rear abutment sections 242 and 252.

In view of the similarities between this second embodiment and the first embodiment, discussed above, this second embodiment will not be discussed and/or illustrated in detail herein. Rather, the following description will focus mainly on the differences between this second embodiment and the first embodiment. However, it will be apparent to those skilled in the art from this disclosure that the descriptions and/or illustrations of components/parts and the operations of the first embodiment also apply to this second embodiment, except as explained below. Moreover, the explanations of components or parts and the operations of this second embodiment that are similar to components or parts and the operations of the first embodiment will be omitted, except as explained below. In other words, only components and operations of this second embodiment that are different in structure and function from the first embodiment will be explained in detail herein.

As mentioned above, the modified base member 222 includes modified front and rear abutment sections 242 and 252 in accordance with this second embodiment of the present invention. Specifically, the base member 222includes modified front and rear abutment sections 242 and 252 that are separate members from a base plate 221. Basically, the base plate 221 is identical to the base member 22 of the first embodiment except that the front and rear abutment sections 42 and 52 of the first embodiment have been removed, and constructed as separate plastic abutment sections 242 and 252, as explained below. Thus, the base plate 221 includes a modified front portion 232 and a modified rear portion 234 in order to accommodate the separate front and rear abutment sections 242 and 252, respectively. The base plate 221 is preferably formed stamping, casting, machining and/or by bending a metal sheet material such as aluminum or aluminum alloy. The remaining parts of the base member 222 are identical or substantially identical to the base member 22 of the first embodiment except as explained and illustrated herein.

The front portion 232 is basically a planar member with upper and lower surfaces 233*a* and 233*b*, respectively, and a plurality (4) of tapered through holes 233*c*. The front portion 232 does not include a recess or a slot like the front portion 32 of the first embodiment. Similarly, the rear portion 234 is basically a planar member with upper and lower surfaces 235*a* and 235*b*, respectively, and a plurality (4) of tapered through holes 235*c*. The rear portion 234 does not include a recess or a slot like the rear portion 34 of the first embodiment. The front and rear portions 232 and 234 are designed to have the front and rear binding members 224 and 226 coupled to their upper surfaces 233*c* and 235*c* via the front and rear abutment sections 242 and 252, respectively.

The front abutment section 242 includes a front recess 244, a front slot 246 and a plurality (4) of stepped through bores 248 configured to fixedly couple the front binding member 224 to the front portion 232 of the base plate 221. The front slot 246 has a configuration identical to the front slot 46 of the first embodiment. Additionally, the front recess 244 has a configuration identical to the front recess 44 of the first embodiment, except the front recess 244 is formed in the lower surface of the front abutment section 242. Thus, the front binding member 224 is mounted within the front recess 244 and the front slot 246 in a manner identical to the first embodiment. A plurality (4) of bolts 278*a* and a plurality (4) of nuts 278*b* are then used to couple the front binding member 224 and the front abutment section 242 to the front portion 232 of the base plate 221.

The rear abutment section 252 includes a rear recess 254, a rear slot 256 and a plurality (4) of stepped through bores 258 configured to fixedly couple the rear binding member or mechanism 226 to the rear portion 234 of the base plate 221. The rear slot 256 has a configuration identical to the rear slot 56 of the first embodiment. Additionally, the rear recess 254 has a configuration identical to the rear recess 54 of the first embodiment, except the rear recess 254 is formed in the lower surface of the rear abutment section 252. Thus, the rear binding mechanism 226 is mounted within the rear recess 254 and the rear slot 256 in a manner identical to the first embodiment. A plurality (4) of the bolts 278*a* and a plurality (4) of the nuts 278*b* are then used to couple the rear binding mechanism 226 and the rear abutment section 252 to the rear portion 252 of the base plate 221.

Third Embodiment

Referring now to FIGS. 60–63, parts of a modified snowboard binding system in accordance with a third embodiment of the present invention will now be discussed. This modified snowboard binding system of this third embodiment basically includes a modified snowboard binding 312 and a modified snowboard boot 314. Basically, this third embodiment is identical to the first embodiment except that the binding arrangements have been reversed.

In view of the similarities between this third embodiment and the first embodiment, discussed above, this third embodiment will not be discussed and/or illustrated in detail herein. Rather, the following description will focus mainly on the differences between this third embodiment and the first embodiment. However, it will be apparent to those skilled in the art from this disclosure that the descriptions and/or illustrations of components/parts and the operations of the first embodiment also apply to this third embodiment, except as explained below. Moreover, the explanations of components or parts and the operations of this third embodiment that are similar to components or parts and the operations of the first embodiment will be omitted, except as explained below. In other words, only components and operations of this third embodiment that are different in structure and function from the first embodiment will be explained in detail herein.

The snowboard boot 314 of this third embodiment is identical to the snowboard boot 14 of the first embodiment, except the so-called front catch 46 of the first embodiment is a rear catch 346 in this third embodiment and the so-called rear catch 48 of the first embodiment is a front catch 348 in this third embodiment. In other words, while the catches 346 and 348 are identical to the catches 46 and 48 of the first embodiment, the catches 346 and 348 are mounted at opposite ends of the snowboard boot 314. Thus, the snowboard boot 314 preferably includes a modified sole 342 to accommodate the arrangement of the catches 346 and 348, and an upper portion (not shown). In particular, the modified sole includes an outer sole 350 and a modified mid sole 352. Certain elements of the mid sole are reversed so that the catches 346 and 348 can be coupled thereto in a manner identical to the first embodiment.

The snowboard binding 312 includes a modified base member 322 in accordance with the present invention. Specifically, the base member 322 includes a modified front abutment section 342 and a modified rear abutment section 352. Otherwise, the snowboard binding 312 is identical to the snowboard binding 12 of the first embodiment. Thus, the snowboard binding 312 basically includes the modified base member 322, a front binding member or mechanism 324 and a rear binding member or mechanism 326. The snowboard binding 312 is designed to be used with the heel cup 28 and the high back 30 of the first embodiment. In this third embodiment, the front binding member or mechanism 324 is identical to the rear binding member or mechanism 26 of the first embodiment. Additionally, the rear binding mechanism or member 326 is identical to the front binding mechanism 24 of the first embodiment.

In order to accommodate the binding members 324 and 326, the base member 322 includes a front portion 332 which is identical to the rear portion 34 of the first embodiment. Additionally, the base member 322 includes a rear portion 334 that is substantially identical to the front portion 32 of the first embodiment.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A snowboard binding, comprising:

a base member including at least one recess, a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member; and a rear abutment section extending upwardly from said rear portion of said base member, said rear abutment section laterally supporting said rear binding member, at least one of said front and rear binding members including an attachment plate for being received by said at least one recess.

2. The snowboard binding according to claim 1, wherein said front and rear abutment sections are integrally formed with said base member as a one-piece, unitary member.

3. The snowboard binding according to claim 1, wherein said front binding member includes an upwardly extending front binding plate, and said front abutment section includes a front slot with said front binding plate received therein to laterally support said front binding member.

4. The snowboard binding according to claim 3, wherein said rear binding member includes an upwardly extending rear binding plate, and said rear abutment section includes a rear slot with said rear binding plate received therein to laterally support said rear binding member.

5. The snowboard binding according to claim 4, wherein said front and rear slots are longitudinally extending slots substantially parallel to said longitudinal axis of said base member.

6. The snowboard binding according to claim 3, wherein said base member includes a front recess formed in a lower surface thereof, and said front binding member includes a front attachment plate received in said front recess.

7. The snowboard binding according to claim 6, wherein said front attachment plate has a bottom surface substantially parallel to said lower surface of said base member.

8. The snowboard binding according to claim 6, wherein said front binding member is formed of two-pieces.

9. The snowboard binding according to claim 3, wherein said front binding member includes a non-movable front claw formed at an upper free end of said front binding plate, said front claw extending upwardly above said front abutment section.

10. The snowboard binding according to claim 1, wherein said rear binding member includes an upwardly extending rear binding plate, and said rear abutment section includes a rear slot with said rear binding plate received therein to laterally support said rear binding member.

11. The snowboard binding according to claim 10, wherein said base member includes a rear recess formed in a lower surface thereof, and said rear binding member includes a rear attachment plate received in said rear recess.

12. The snowboard binding according to claim 11, wherein said rear attachment plate has a bottom surface substantially parallel to said lower surface of said base member.

13. The snowboard binding according to claim 11, wherein said rear binding member includes two pieces with each of said two pieces forming part of said rear attachment plate and part of said rear binding plate.

14. The snowboard binding according to claim 13, wherein said rear binding plate is formed of two laterally spaced binding sections.

15. The snowboard binding according to claim 10, wherein said rear binding member includes a movable rear claw coupled to said rear binding plate.

16. The snowboard binding according to claim 1, further comprising a central rib section arranged between said front and rear abutment sections, said central rib section extending upwardly from said base member, and said central rib section substantially surrounds said central attachment area.

17. The snowboard binding according to claim 16 wherein said front abutment section includes a pair of laterally spaced front abutment surfaces that are at least partially disposed above a top attachment surface of said central attachment area.

18. The snowboard binding according to claim 16, wherein said rear abutment section includes a pair of laterally spaced rear abutment surfaces that are at least partially disposed above a top attachment surface of said central attachment area.

19. The snowboard binding according to claim 16, wherein said central rib section includes an upper surface that is spaced above a top attachment surface of said central attachment area.

20. The snowboard binding according to claim 16, wherein said central rib section includes a pair of planar upper surface sections arranged on opposite lateral sides of said central attachment area.

21. The snowboard binding according to claim 16, wherein said front abutment section, said rear abutment section and said central rib section form parts of a rib structure that is integrally formed with said base member as a one-piece, unitary member.

22. The snowboard binding according to claim 1, wherein said front abutment section includes a pair of laterally spaced front abutment surfaces that are at least partially disposed above a top attachment surface of said central attachment area, and said rear abutment section includes a pair of laterally spaced rear abutment surfaces that are at least partially disposed above said top attachment surface of said central attachment area.

23. The snowboard binding according to claim 1, wherein said central attachment area includes an attachment opening with an adjustment disk adjustably coupled thereto, said adjustment disk being arranged and configured to be fixedly coupled to the snowboard.

24. The snowboard binding according to claim 1, wherein said front and rear abutment sections are separate members that are attached to an upper surface of said base member.

25. The snowboard binding according to claim 24, wherein said base member is a one-piece plate with a predetermined shape.

26. The snowboard binding according to claim 1, wherein said front abutment section is a separate member that is attached to an upper surface of said base member.

27. The snowboard binding according to claim 26, wherein said base member is a one-piece plate with a predetermined shape.

28. The snowboard binding according to claim 26, wherein said front binding member is formed of two-pieces.

29. The snowboard binding according to claim 26, wherein said front abutment section includes a front recess formed in a lower surface thereof, and said front binding member includes a front attachment plate that is attached to an upper surface of said base member and disposed in said front recess.

30. The snowboard binding according to claim 1, wherein said rear abutment section is a separate member that is attached to an upper surface of said base member.

31. The snowboard binding according to claim 30, wherein said base member is a one-piece plate with a predetermined shape.

32. The snowboard binding according to claim 30, wherein said rear binding member includes two pieces with each of said two pieces forming a part of a rear attachment plate that is attached to an upper surface of said base member and a part of a rear binding plate that extends upwardly from said rear attachment plate.

33. The snowboard binding according to claim 30, wherein said rear abutment section includes a rear recess formed in a lower surface thereof, and said rear binding member includes a rear attachment plate that is attached to an upper surface of said base member and disposed in said rear recess.

34. A snowboard binding, comprising:

a base member including a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member; and a rear abutment section extending upwardly from said rear portion of said base member, said rear abutment section laterally supporting said rear binding member, said front binding member including an upwardly extending front binding plate, and said front abutment section including a front slot with said front binding plate received therein to laterally support said front binding member, said base member including a front recess formed in a lower surface thereof, and said front binding member including a front attachment plate received in said front recess.

35. The snowboard binding according to claim 34, wherein said front attachment plate has a bottom surface substantially parallel to said lower surface of said base member.

36. The snowboard binding according to claim 34, wherein said front binding member is formed of two-pieces.

37. A snowboard binding, comprising:

a base member including a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member; and a rear abutment section extending upwardly from said rear portion of said base member, said rear abutment section laterally supporting said rear binding member, said rear binding member including an upwardly extending rear binding plate, and said rear abutment section including a rear slot with said rear binding plate received therein to laterally support said rear binding member, said base member including a rear recess formed in a lower surface thereof, and said rear binding member including a rear attachment plate received in said rear recess.

38. The snowboard binding according to claim 37, wherein said rear attachment plate has a bottom surface substantially parallel to said lower surface of said base member.

39. The snowboard binding according to claim 37, wherein said rear binding member includes two pieces with each of said two pieces forming part of said rear attachment plate and part of said rear binding plate.

40. The snowboard binding according to claim 39, wherein said rear binding plate is formed of two laterally spaced binding sections.

41. A snowboard binding, comprising:

a base member including a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member;

a rear abutment section extending upwardly from said rear portion of said base member, said rear abutment section laterally supporting said rear binding member; and a central rib section arranged between said front and rear abutment sections, said central rib section extending upwardly from said base member, and said central rib section substantially surrounding said central attachment area.

42. The snowboard binding according to claim 41 wherein said front abutment section includes a pair of laterally spaced front abutment surfaces that are at least partially disposed above a top attachment surface of said central attachment area.

43. The snowboard binding according to claim 41, wherein said rear abutment section includes a pair of laterally spaced rear abutment surfaces that are at least partially disposed above a top attachment surface of said central attachment area.

44. The snowboard binding according to claim 41, wherein said central rib section includes an upper surface that is spaced above a top attachment surface of said central attachment area.

45. The snowboard binding according to claim 41, wherein said central rib section includes a pair of planar upper surface sections arranged on opposite lateral sides of said central attachment area.

46. The snowboard binding according to claim 41, wherein said front abutment section, said rear abutment section and said central rib section form parts of a rib structure that is integrally formed with said base member as a one-piece, unitary member.

47. A snowboard binding, comprising:

a base member including a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member; and a rear abutment section extending upwardly from said rear portion of said base member, said rear abutment section laterally supporting said rear binding member, said front abutment section is a separate member being attached to an upper surface of said base member, said front abutment section including a front recess formed in a lower surface thereof, and said front binding member including a front attachment plate being attached to an upper surface of said base member and disposed in said front recess.

48. A snowboard binding, comprising:

a base member including a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member; and a rear abutment section extending upwardly from said rear portion of said base member, said rear abutment section laterally supporting said rear binding member, said rear abutment section is a separate member being attached to an upper surface of said base member, and said rear binding member including two pieces with each of said two pieces forming a part of a rear attachment plate that is attached to an upper surface of said base member and a part of a rear binding plate that extends upwardly from said rear attachment plate.

49. A snowboard binding, comprising:

a base member including a front portion, a rear portion, a central portion arranged between said front and rear portions and a longitudinal axis extending between said front and rear portions, said central portion having a central attachment area configured to be fixedly coupled to a snowboard;

a front binding member coupled to said base member at said front portion of said base member, said front binding member being arranged and configured to selectively engage a front cleat of a snowboard boot;

a rear binding member coupled to said base member at said rear portion of said base member, said rear binding member being arranged and configured to selectively engage a rear cleat of the snowboard boot;

a front abutment section extending upwardly from said front portion of said base member, said front abutment section laterally supporting said front binding member; and a rear abutment section extending upwardly from said rear portion of said base member, said rear abutment section laterally supporting said rear binding member, said rear abutment section is a separate member being attached to an upper surface of said base member, said rear abutment section including a rear recess formed in a lower surface thereof, and said rear binding member including a rear attachment plate that is attached to an upper surface of said base member and disposed in said rear recess.

* * * * *